US008783808B2

(12) United States Patent
Takekoshi et al.

(10) Patent No.: US 8,783,808 B2
(45) Date of Patent: Jul. 22, 2014

(54) INKJET PRINTING DEVICE AND INKJET PRINTING METHOD

(75) Inventors: Rie Takekoshi, Kawasaki (JP); Ayumi Hirakawa, Kawasaki (JP); Takumi Kaneko, Tokyo (JP); Yumi Kamimura, Inagi (JP); Kazuki Narumi, Kawasaki (JP); Noboru Kunimine, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 13/323,653

(22) Filed: Dec. 12, 2011

(65) Prior Publication Data

US 2012/0154468 A1 Jun. 21, 2012

(30) Foreign Application Priority Data

Dec. 17, 2010 (JP) ..... 2010-281935

(51) Int. Cl.
*B41J 29/38* (2006.01)

(52) U.S. Cl.
USPC ..... 347/14

(58) Field of Classification Search
USPC ..... 347/5–19, 40–43, 101, 107
IPC ..... B41J 29/38
See application file for complete search history.

(56) References Cited

U.S. PATENT DOCUMENTS

| | | | | |
|---|---|---|---|---|
| 2008/0246791 | A1* | 10/2008 | Kaneko et al. | 347/14 |
| 2009/0058895 | A1* | 3/2009 | Kida | 347/8 |
| 2009/0073202 | A1* | 3/2009 | Kanda et al. | 347/9 |
| 2009/0160885 | A1* | 6/2009 | Takekoshi et al. | 347/6 |

FOREIGN PATENT DOCUMENTS

| | | | |
|---|---|---|---|
| JP | 2000-153677 | A | 6/2000 |
| JP | 2004-001446 | A | 1/2004 |

* cited by examiner

*Primary Examiner* — Manish S Shah
*Assistant Examiner* — Roger W Pisha, II
(74) *Attorney, Agent, or Firm* — Canon USA, Inc., IP Division

(57) ABSTRACT

An inkjet printing device having a print head that ejects a plurality of types of inks has: an ejection unit configured to, on the basis of ejection data that scans the print head a plurality of times to eject the inks from the print head to a predetermined area of a print medium, eject the inks to print an image; wherein the inks are classified into a first ink having a relatively large contact angle and a second ink having a relatively small contact angle, and wherein the ejection data is ejection data that, if a difference in application amount between the first ink and the second ink to be ejected to the predetermined area by the ejection unit is larger than a predetermined value, increases a ratio at which an ink having a smaller application amount is ejected in last half scans among the plurality of times of scans.

11 Claims, 14 Drawing Sheets

| | BLACK INK | LIGHT CYAN INK |
|---|---|---|
| CONTACT ANGLE | 33 DEGREES | 57 DEGREES |

FIG.8A

| | BLACK INK | LIGHT CYAN INK |
|---|---|---|
| SURFACE ROUGHNESS Ra | 79 nm | 145 nm |
| GLOSSINESS DEGREE | 104 | 26 |
| HAZE VALUE (%) | 24 | 21 |

FIG.8B

INKJET PRINTING DEVICE AND INKJET PRINTING METHOD

BACKGROUND OF THE INVENTION

1. Field of the Invention

The present invention relates to a multipass system inkjet printing device and inkjet printing method that print an image while, with respect to a print medium, scanning a printing unit that ejects a plurality of types of inks. More particularly, the present invention relates to an inkjet printing device and inkjet printing method that reduce gloss unevenness and interference color unevenness of an image.

2. Description of the Related Art

Due to recent advancement of manufacturing technologies, pigment ink can achieve both conventional long-term preserving performance superior to dye ink and a high color development property comparable to the dye ink. For this reason, inkjet printing using the pigment ink is spread mainly for use in photographs, posters, and the like of which printed images are required to be preserved for a long term.

However, in the case of using the pigment ink, a problem in image quality, which is not present in silver halide photography, becomes important, such as gloss unevenness that occurs due to unevenness of glossiness of an image. Also, as the number of display uses such as posters is increased, the fact that image fastness representing image intensity or long-term preserving performance is low as compared with offset printed matter is also taken as a new problem.

In order to solve the problems such as gloss unevenness and fastness, Japanese Patent Laid-Open No. 2000-153677 discloses a configuration using a laminate system that, after an image has been printed, covers the image with a transparent resin layer made of a transfer film. Also, Japanese Patent Laid-Open No. 2004-1446 discloses a configuration using a processing system that applies transparent processing liquid containing resin to a whole of an image surface.

SUMMARY OF THE INVENTION

However, in the system that, after an image has been printed, covers a surface of the image with the resin layer made of the transfer film, a working process is complicated, and a work space and system become large-scaled, such as the need of a laminate device in addition to a printing device. Also, in the system that, after an image has been printed, wholly covers a surface of the image with the transparent processing liquid, a surface of a transparent layer is finished as a mirrored surface, which reduces gloss unevenness to obtain a sense of uniform glossiness; however, at the same time, interference color unevenness due to a thin film interference phenomenon may appear to damage image quality.

The term "thin film interference phenomenon" refers to a phenomenon that light that is reflected by a surface of a film and light that passes through the surface of the film and is reflected by a back side of the film interfere with each other to mutually increase or cancel light intensity, and consequently interference color develops. It is known that the interference color is varied depending on a film thickness.

The present invention is made in order to solve the above problems, and has an object to provide an inkjet printing device and inkjet printing method that enables the problems of gloss unevenness and interference color unevenness to be solved with using a simple working process without using a large-scale system or working space.

An inkjet printing device of the present invention to solve the above problems is an inkjet printing device having a print head that ejects a plurality of types of inks, and provided with an ejection unit configured to, on the basis of ejection data that scans the print head a plurality of times to eject the plurality of types of inks from the print head to a predetermined area of a print medium, eject the plurality of types of inks from the print head to the predetermined area to print an image; wherein the plurality of types of inks are classified into a first ink having a relatively large contact angle and a second ink having a relatively small contact angle, and wherein the ejection data is ejection data that, if a difference in application amount between the first ink and the second ink to be ejected to the predetermined area by the ejection unit is larger than a predetermined value, increases a ratio at which an ink having a smaller application amount is ejected in last half scans among the plurality of times of scans.

Also, an inkjet printing device of the present invention to solve the above problems is an inkjet printing device having a print head provided with: ejection ports that eject a plurality of types of inks; and an ejection port that ejects processing liquid having a property of improving performance of an image, and provided with an ejection unit configured to, on the basis of ejection data that scans the print head a plurality of times to eject the plurality of types of inks from the print head to a predetermined area of a print medium, eject the plurality of types of inks from the print head to the predetermined area to print an image, and on the basis of ejection data that scans the print head to eject the processing liquid from the print head to the predetermined area, eject the processing liquid from the print head onto the image printed with the plurality of types of inks and thereby cover the image with the processing liquid; wherein the plurality of types of inks are classified into a first ink having a relatively large contact angle and a second ink having a relatively small contact angle, and wherein the ejection data that ejects the plurality of types of inks is ejection data that, if a difference in application amount between the first ink and the second ink to be ejected to the predetermined area by the ejection unit is larger than a predetermined value, increases a ratio at which an ink having a smaller application amount is ejected in last half scans among the plurality of times of scans, and thereby controls a surface roughness value of the image to be printed with the plurality of types of inks to fall within a predetermined range.

Further, an inkjet printing method of the present invention to solve the above problems is an inkjet printing method by an inkjet printing device having a print head that ejects a plurality of types of inks, and includes an ejection step of, on the basis of ejection data that scans the print head a plurality of times to eject the plurality of types of inks from the print head to a predetermined area of a print medium, ejecting the plurality of types of inks from the print head to the predetermined area to print an image; wherein the plurality of types of inks are classified into a first ink having a relatively large contact angle and a second ink having a relatively small contact angle, and wherein the ejection data is ejection data that, if a difference in application amount between the first ink and the second ink to be ejected to the predetermined area by the ejection step is larger than a predetermined value, increases a ratio at which an ink having a smaller application amount is ejected in last half scans among the plurality of times of scans.

Still further, an inkjet printing method of the present invention to solve the above problems is an inkjet printing method by an inkjet printing device having a print head provided with: ejection ports that eject a plurality of types of inks; and an ejection port that ejects processing liquid having a property of improving performance of an image, and includes an ejection step of, on the basis of ejection data that scans the print head a plurality of times to eject the plurality of types of inks from the print head to a predetermined area of a print medium, ejecting the plurality of types of inks from the print head to the predetermined area to print an image, and on the basis of ejection data that scans the print head to eject the processing liquid from the print head to the predetermined area, ejecting the processing liquid from the print head onto the image printed with the plurality of types of inks and thereby cover the image with the processing liquid; wherein the plurality of types of inks are classified into a first ink having a relatively large contact angle and a second ink having a relatively small contact angle, and wherein the ejection data that ejects the plurality of types of inks is ejection data that, if a difference in application amount between the first ink and the second ink to be ejected to the predetermined area by the ejection step is larger than a predetermined value, increases a ratio at which an ink having a smaller application amount is ejected in last half scans among the plurality of times of scans, and thereby controls a surface roughness value of the image to be printed with the plurality of types of inks to fall within a predetermined range.

According to the present invention, in inkjet printing, on the basis of a relative size relationship in contact angle among inks used to print an image, an application order of the inks can be optimized with use of a relatively simple configuration. Specifically, if a difference in application amount between an ink having a relatively large contact angle (ink having low wettability) and an ink having a relatively small contact angle (ink having high wettability) is larger than a predetermined value, an ink having a smaller application amount is applied in last half scans among a plurality of times of scans. This enables image performance having uniformed gloss unevenness in a predetermined area to be achieved. Also, according to the present invention, interference color unevenness that occurs when processing liquid for improving the performance is further applied to an image printed with inks can be reduced.

Further features of the present invention will become apparent from the following description of exemplary embodiments (with reference to the attached drawings).

BRIEF DESCRIPTION OF THE DRAWINGS

FIGS. 8A and 8B are tables respectively listing contact angles of the black and light cyan inks, and surface roughness values, glossiness degrees, and haze values of images printed with these inks;

DESCRIPTION OF THE EMBODIMENTS

Figure 1:
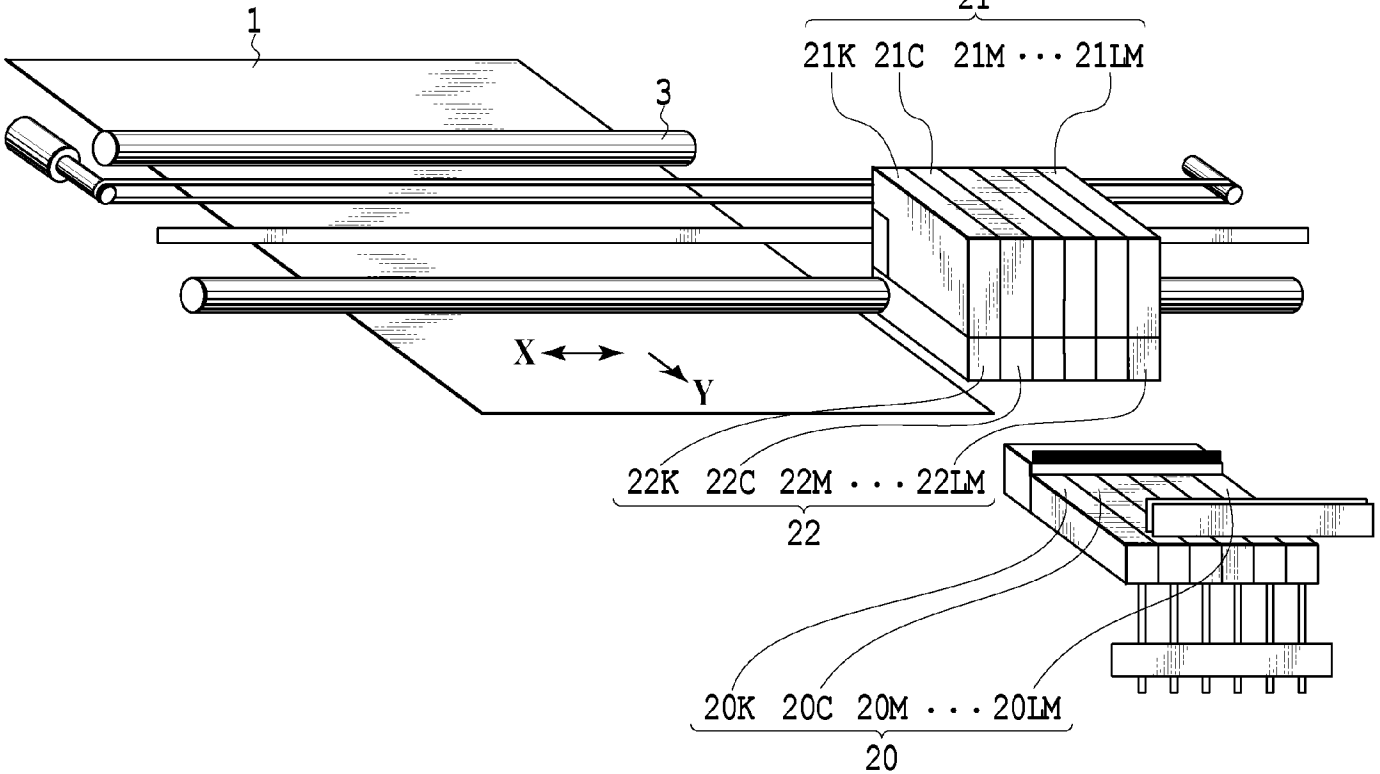
FIG. 1 is a perspective view illustrating a main part of an inkjet printing device in an embodiment of the present invention.

"Ink having a relatively large contact angle" herein refers to ink that improves image performance such as image fastness and image quality. Also, "processing liquid" refers to liquid (image performance improving liquid) that is brought into contact with ink to thereby improve image performance such as image fastness and image quality.

Here, "to improve the image fastness" means that at least one of scratch resistance, weather resistance, water resistance, and alkali resistance is improves to improve fastness of an ink image. On the other hand, "to improve the image quality" means that at least one of glossiness, haziness, and a bronzing characteristic is improved to improve quality of an ink image.

Here, the "scratch resistance" is performance that is evaluated by a minimum load value measured according to a method provided in JIS K 5600-5-5. Also, "to improve the scratch resistance" means "to increase the minimum load value".

Also, the "weather resistance" is performance that is evaluated by a degree of variation (class) measured according to a method provided in JIS K 5600-7. For example, to evaluate a degree of color variation, color difference or the like is used. Also, "to improve the weather resistance" means "to reduce a value of the degree of variation (class)".

Further, each of the "water resistance" and "alkali resistance" is performance that is evaluated by observing a sign of damage measured according to a method provided in JIS K 5600-6-1. Also, "to improve the water resistance" means "to decrease the sign of damage".

Still further, the "glossiness" is performance that is evaluated by a glossiness degree measured according to a method provided in JIS K 5600-4-7. Also, "to improve the glossiness" means "to increase the glossiness degree".

Yet further, the "haziness" is performance that is evaluated by a haze value measured according to a method provided in JIS K 7374. Also, "to improve the haziness" means "to reduce the haze value".

Yet still further, the "bronzing characteristic" is performance that is evaluated by chromaticity measured according to a method provided in JIS K 0115. Also, "to improve the bronzing characteristic" means "to make a value of the chromaticity achromatic".

In the present embodiment, regarding the "ink having a relatively large contact angle", ink added with a large amount of resin as compared with the "ink having a relatively small contact angle" in order to improve the scratch resistance included in the image fastness is cited as an example to provide description. That is, the "ink having a relatively small contact angle" may be added with a smaller amount of the resin than the "ink having a relatively large contact angle" or may not be added with the resin. Also, regarding the "processing liquid", processing liquid that improves the scratch property included in the image fastness and the glossiness and haziness included in the image quality is cited as an example to provide description.

<First Embodiment>

With reference to the drawings, a preferred embodiment of the present invention is described in detail. In the following, a first embodiment of the present invention is described with being sorted into items (overall configuration), (ink composition), (characteristic configuration), (configuration example of image processing system), (image processing), and (printing operation).

(Overall configuration)

An overall configuration of an inkjet printing device in the first embodiment of the present invention is described. FIG. 1 is a perspective view illustrating a main part of the inkjet printing device of the present embodiment.

A print head 22 is configured to have six print heads 22K, 22C, 22M, . . . , 22LM that respectively eject black (K), cyan (C), magenta (M), yellow (Y), light cyan (LC), and light magenta (LM) inks. The inks are ejected onto a print medium 1 from ejection ports provided in the print head to thereby perform printing. Also, an ink tank 21 is configured to have six ink tanks 21K, 21C, 21M, . . . , 21LM that respectively store the corresponding color inks that are to be supplied to the print heads 22K, 22C, 22M, . . . , 22LM. Further, the print head 22 and ink tank 21 are adapted to be movable in a main scanning direction (direction indicated by an arrow X). Regarding the print head 22 and ink tank 21 used herein, the print head and ink tank may be integrally configured, or configured to be able to be separated from each other. The print medium 1 is, before and after the movement of the print head in the main scanning direction X, conveyed by a conveying roller 3 in a sub scanning direction (direction indicated by an arrow Y) intersecting with the main scanning direction X as necessary.

A cap 20 is configured to have six caps 20K, 20C, 20M, . . . , 20LM in order to cap respective ink ejection surfaces (ejection port forming surface) of the six print heads. When printing is not performed, the print head 22 and ink tank 21 return to a home position where the cap 20 is present, and wait. Then, after the print head 22 has kept waiting at the home position for a certain period of time, the print head 22 is capped to prevent the ink ejection surfaces of the print head 22 from being dried.

In this specification, in the case where the print heads or ink tanks are individually referred to, the reference numerals respectively added to them are used, whereas in the case where the print heads or ink tanks are collectively referred to, as the generic reference numeral, "22", "21", or "20" is used for the print head, ink tank, or cap.

Figure 2A:
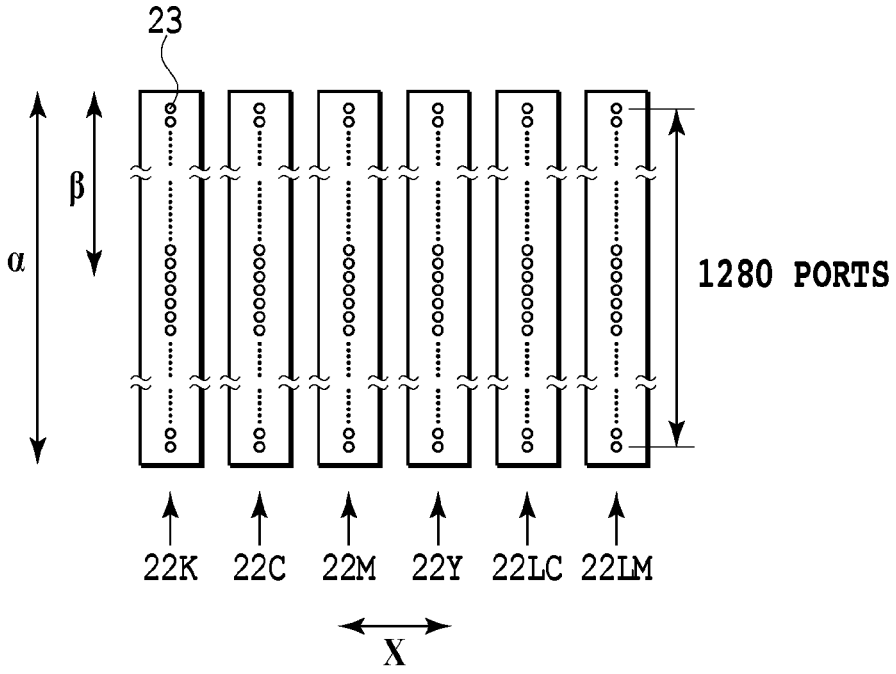
FIG. 2A is a diagram of a print head used in a first embodiment of the present invention as viewed from an ejection port side.

FIG. 2A is a diagram of the print head 22 as viewed from an ejection port side. In each of the print heads 22K, 22C, 22M, . . . , 22LM, 1280 ejection ports 23 are arrayed at a density of 1200 dpi along a direction orthogonal to the main scanning direction X to form an ejection port array for each of the colors. An ejection amount of ink ejected from each of the ejection ports 23 at one time is approximately 4.5 ng.

(Ink Composition)

Next, compositions of the inks used in the present embodiment are described. As will be described later, each of the light cyan and light magenta inks is ink having a relatively large contact angle, and contains a large amount of resin for improving the scratch resistance. On the other hand, each of the black, cyan, magenta, and yellow inks is ink having a relatively small contact angle, and does not contain the resin for improving the scratch resistance. In the following, a "portion" and "%" are, unless otherwise noted, based on amass.

1. Black Ink (1) Preparation of Dispersion Liquid

First, an anionic polymer P-1 [styrene/butyl acrylate/acrylic acid copolymer (polymerization ratio (weight ratio)=30/40/30), acid value of 202, weight average molecular weight of 6500] was prepared. This was neutralized with a potassium hydroxide solution and then diluted with ion-exchanged water to prepare a homogenous 10 weight % polymer solution.

600 g of the above polymer solution, 100 g of carbon black, and 300 g of ion exchanged water were mixed and mechanically stirred for a predetermined period of time, then from which non-dispersion materials including coarse particles were removed by a centrifugal process to prepare black dispersion liquid. The resultant black dispersion liquid had a pigment concentration of 10 weight %.

(2) Preparation of Ink

To prepare the ink, the above black dispersion liquid was used; added with the following constituents; and thereby regulated to a predetermined concentration. Then, after the constituents had been sufficiently mixed and stirred, the resultant liquid was pressurized and filtered with a micro filter having a pore size of 2.5 μm (manufactured by Fuji Film) to prepare the pigment ink having a pigment concentration of 5 weight %.

| | |
|---|---|
| Above black dispersion solution | 50 portions |
| Glycerin | 10 portions |
| Triethylene glycol | 10 portions |
| Acetylene glycol EO adduct (manufactured by Kawaken Fine Chemicals Co., Ltd) | 0.5 portions |
| Ion-exchanged water | 29.5 portions |

2. Cyan Ink (1) Preparation of Dispersion Liquid

First, benzyl acrylate and methacrylic acid were used as raw materials to prepare an AB type block polymer having an acid value of 250 and a number average molecular weight of 3000 through a common procedure, which was then neutralized with a potassium hydroxide solution and diluted with ion-exchange water to prepare a homogeneous 50 weight % polymer solution.

200 g of the above polymer solution, 100 g of C.I. Pigment Blue 15:3, and 700 g of ion-exchanged water were mixed and mechanically stirred for a predetermined period of time, then from which non-dispersion materials including coarse particles were removed by a centrifugal process to prepare cyan dispersion liquid. The resultant cyan dispersion liquid had a pigment concentration of 10 weight %.

(2) Preparation of Ink

To prepare the ink, the above cyan dispersion liquid was used; added with the following constituents; and thereby regulated to a predetermined concentration. Then, after the constituents had been sufficiently mixed and stirred, the resultant liquid was pressurized and filtered with a micro filter having a pore size of 2.5 μm (manufactured by Fuji Film) to prepare the pigment ink having a pigment concentration of 2 weight %.

| | |
|---|---|
| Above cyan dispersion solution | 20 portions |
| Glycerin | 10 portions |
| Diethylene glycol | 10 portions |
| Acetylene glycol EO adduct (manufactured by Kawaken Fine Chemicals Co., Ltd) | 0.5 portions |
| Ion-exchanged water | 59.5 portions |

3. Magenta Ink (1) Preparation of Dispersion Liquid

First, benzyl acrylate and methacrylic acid were used as raw materials to prepare an AB type block polymer having an acid value of 300 and a number average molecular weight of 2500 through a common procedure, which was then neutralized with a potassium hydroxide solution and diluted with ion-exchange water to prepare a homogeneous 50 weight % polymer solution.

100 g of the above polymer solution, 100 g of C.I. Pigment Red 122, and 800 g of ion-exchanged water were mixed and mechanically stirred for a predetermined period of time, then from which non-dispersion materials including coarse particles were removed by a centrifugal process to prepare magenta dispersion liquid. The resultant magenta dispersion liquid had a pigment concentration of 10 weight %.

(2) Preparation of Ink

To prepare the ink, the above magenta dispersion liquid was used; added with the following constituents; and thereby regulated to a predetermined concentration. Then, after the constituents had been sufficiently mixed and stirred, the resultant liquid was pressurized and filtered with a micro filter having a pore size of 2.5 μm (manufactured by Fuji Film) to prepare the pigment ink having a pigment concentration of 4 weight %.

| | |
|---|---|
| Above magenta dispersion solution | 40 portions |
| Glycerin | 10 portions |
| Diethylene glycol | 10 portions |
| Acetylene glycol EO adduct (manufactured by Kawaken Fine Chemicals Co., Ltd) | 0.5 portions |
| Ion-exchanged water | 39.5 portions |

4. Yellow Ink (1) Preparation of Dispersion Liquid

First, the above anionic polymer P-1 was neutralized with a potassium hydroxide solution and diluted with ion-exchange water to prepare a homogeneous 10 weight % polymer solution.

300 g of the above polymer solution, 100 g of C.I. Pigment Yellow 74, and 600 g of ion-exchanged water were mixed and mechanically stirred for a predetermined period of time, then from which non-dispersion materials including coarse particles were removed by a centrifugal process to prepare yellow dispersion liquid. The resultant yellow dispersion liquid had a pigment concentration of 10 weight %.

(2) Preparation of Ink

The following constituents were mixed and sufficiently stirred; thereby dissolved and dispersed; and then pressurized and filtered with a micro filter having a pore size of 1.0 μm (manufactured by Fuji Film) to prepare the pigment ink having a pigment concentration of 4 weight %.

| | |
|---|---|
| Above yellow dispersion solution | 40 portions |
| Glycerin | 9 portions |
| Ethylene glycol | 10 portions |
| Acetylene glycol EO adduct (manufactured by Kawaken Fine Chemicals Co., Ltd) | 1 portion |
| Ion-exchanged water | 40 portions |

5. Light Magenta Ink (1) Preparation of Dispersion Liquid

On the basis of the same raw materials and preparation method described for the above magenta ink, a magenta dispersion liquid having a pigment concentration of 10 weight % was prepared.

(2) Preparation of Ink

To prepare the ink, the above magenta dispersion liquid was used; added with the following constituents; and thereby regulated to a predetermined concentration. Then, after the constituents had been sufficiently mixed and stirred, the resultant liquid was pressurized and filtered with a micro filter having a pore size of 2.5 μm (manufactured by Fuji Film) to prepare the pigment ink having a pigment concentration of 0.8 weight %.

In addition, as the resin for improving the scratch resistance, a commercially available acrylic silicone copolymer was used.

| | |
|---|---|
| Above magenta dispersion solution | 8 portions |
| Acrylic silicone copolymer (product name: Symac US-450 manufactured by Toagosei Co., Ltd.) | 5 portions |
| Glycerin | 10 portions |
| Diethylene glycol | 10 portions |
| Acetylene glycol EO adduct (manufactured by Kawaken Fine Chemicals Co., Ltd) | 0.5 portions |
| Ion-exchanged water | 66.5 portions |

6. Light Cyan Ink (1) Preparation of Dispersion Liquid

On the basis of the same raw materials and preparation method described for the above magenta ink, a cyan dispersion liquid having a pigment concentration of 10 weight % was prepared.

(2) Preparation of Ink

To prepare the ink, the above cyan dispersion liquid was used; added with the following constituents; and thereby regulated to a predetermined concentration. Then, after the constituents had been sufficiently mixed and stirred, the resultant liquid was pressurized and filtered with a micro filter having a pore size of 2.5 μm (manufactured by Fuji Film) to prepare the pigment ink having a pigment concentration of 0.4 weight %.

In addition, as the resin for improving the scratch resistance, the commercially available acrylic silicone copolymer was used.

| | |
|---|---|
| Above cyan dispersion solution | 4 portions |
| Acrylic silicone copolymer (product name: Symac US-450 manufactured by Toagosei Co., Ltd.) | 5 portions |
| Glycerin | 10 portions |
| Diethylene glycol | 10 portions |
| Acetylene glycol EO adduct (manufactured by Kawaken Fine Chemicals Co., Ltd) | 0.5 portions |
| Ion-exchanged water | 70.5 portions |

The light cyan and light magenta inks of the present embodiment are made to contain the resin material for improving the scratch resistance of a printed image. For this reason, as compared with the black, cyan, magenta, and yellow inks (inks having a relatively small contact angle) that are not made to contain the resin material, the light cyan and light magenta inks are the "inks having a relatively large contact angle". As such a resin material, there is a resin material formed by copolymerizing a polydimethylsiloxane constituent, and in the case of using this, even if external force such as a nail is applied on an ink image, slidability appears and thereby a dynamic friction coefficient can be efficiently reduced. In the present embodiment, the commercially available transparent resin material (the above-described acrylic silicone copolymer: Symac US-450) formed by copolymerizing a polydimethylsiloxane constituent is used. Note that in the present embodiment, any material can also be used if the material is a resin material that can improve the scratch resistance included in the image fastness.

(Characteristic Configuration)

In the present embodiment, a difference in contact angle (wettability) among the pigment inks is focused on to optimize an application order of the pigment inks respectively having different contact angles. In the following, the contact angle (wettability) is described.

Figure 7A:
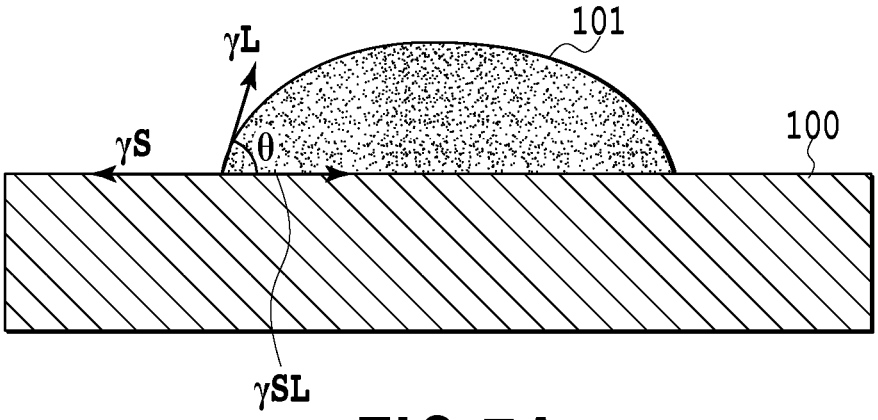
FIGS. 7A and 7B are diagrams for explaining a method for measuring a contact angle of a droplet on a solid surface.
Figure 7B:
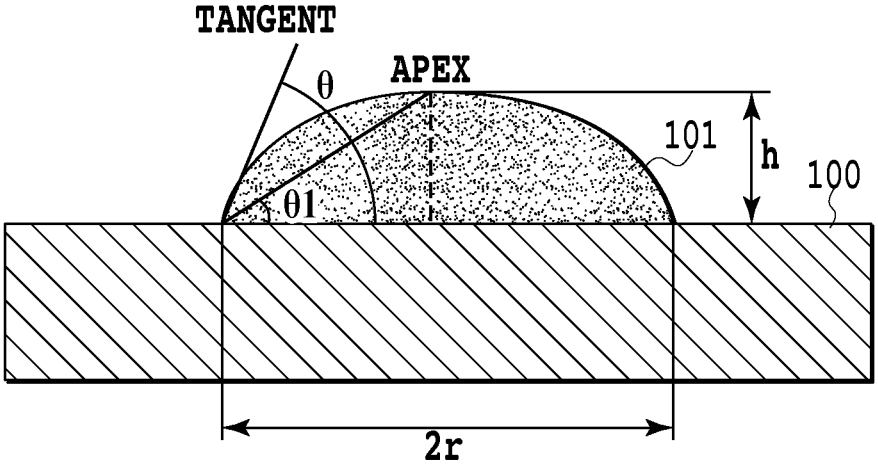

FIGS. 7A and 7B are diagrams for explaining a method for measuring a contact angle of a droplet on a solid surface. In general, as illustrated in FIG. 7A, in the case where the droplet 101 is placed on the solid surface 100 to establish equilibrium in a certain state, the following expression holds:

$$\gamma S=\gamma L \cos\theta+\gamma SL \quad (1)$$

γS: Solid surface tension

γSL: Solid-liquid boundary tension

γL: Liquid surface tension

Expression (1) is called the "Young equation", and in the case where Expression (1) holds, an angle formed by a liquid surface and a solid surface is the "contact angle". It is generally said that the smaller the contact angle, "the higher the wettability", and the larger the contact angle, "the lower the wettability".

As the method for measuring a contact angle, a "θ/2 method" is typically used. The "θ/2 method" is, as illustrated in FIG. 7B, a method that obtains the contact angle θ from an angle $\theta_1$ of a straight line connecting between a left or right end point and apex of the droplet with respect to the solid surface. By assuming that a shape of the droplet is a part of a circle, the following expression holds from a geometric theorem:

$$2\theta_1=\theta \quad (2)$$

However, the "θ/2 method" is, as described above, based on the assumption that a droplet is a part of a sphere, and therefore in the case of measuring a droplet that is crushed by the influence of gravity, an error occurs. For this reason, an analysis based on a tangent method, curve fit method, or the like is sometimes made. Detailed description of the tangent and curve fit methods is omitted.

In this specification, the "contact angle" of ink is defined as follows: That is, a polyethylene (PE) sheet surface is assumed as the solid surface 100; a droplet formed by dropping (ejecting) pigment ink on the polyethylene sheet is assumed as the droplet 101; and a measured angle θ formed by the droplet 101 and a contact part between the droplet 101 and the polyethylene sheet is defined as a contact angle of the pigment ink. Note that, in addition to polyethylene (PE), glass, polyethylene terephthalate (PET), acrylic resin (PMMA), print medium, or the like can also be used. For the measurement, DropMaster manufactured by Kyowa Interface Science Co., Ltd was used. As long as the contact angle of the pigment ink can be measured, a measuring instrument is not limited to the above-exemplified one.

Next, among the pigment inks used in the present embodiment, the black and light cyan inks between which there is a large difference in contact angle value measured by the above-described measuring instrument are cited as an example to describe effectiveness of optimizing an ink application order on the basis of a difference in contact angle (wettability).

FIG. 8A is a table listing respective values of contact angles of the black and light cyan inks with respect to polyethylene (PE). Among the pigment inks used in the present embodiment, a contact angle of the black ink that exhibits a relatively small contact angle was 33 degrees, and a contact angle of the light cyan ink that exhibits a relatively large contact angle was 57 degrees.

Figure 9A:
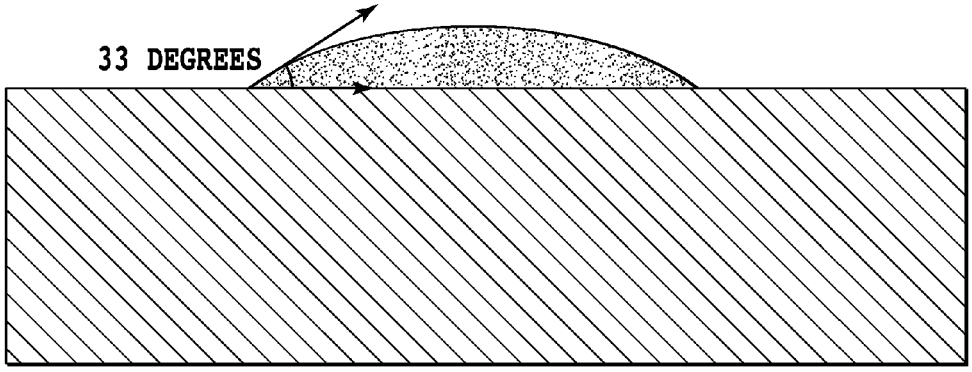
FIGS. 9A and 9B are diagrams for explaining a difference in contact angle for the case of dropping the black and light cyan inks having different contact angles onto a polyethylene (PE) sheet, respectively.
Figure 9B:
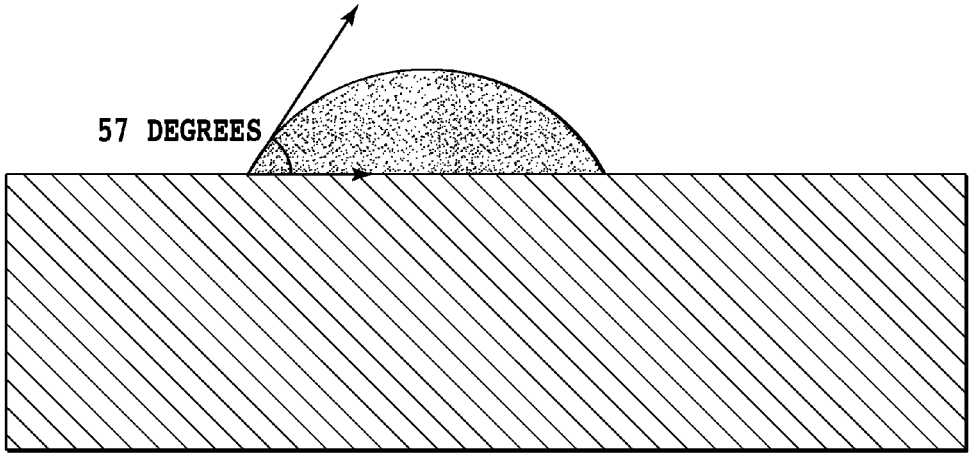

FIGS. 9A and 9B are diagrams for explaining a difference in contact angle for the case of dropping the pigment inks respectively having different contact angles according to the above definition onto the polyethylene (PE) sheet. FIG. 9A illustrates a state where the black ink is dropped, and FIG. 9B illustrates a state where the light cyan ink is dropped.

A value of a contact angle is closely related to a dot spread area and dot height at the time of printing an image with pigment ink. That is, as a value of a contact angle of pigment ink is decreased (wettability is increased), a spread area of the pigment ink increases, and thereby a dot height decreases. On the other hand, a value of a contact angle of pigment ink is increased (wettability is decreased), a spread area of the pigment ink decreases, and thereby a dot height increases.

Figure 5A:
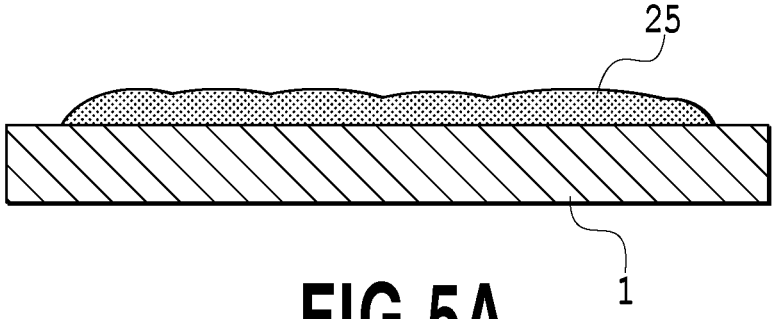
FIGS. 5A and 5B are diagrams for explaining a difference in surface shape between images printed with black and light cyan inks having different contact angles, respectively.
Figure 5B:
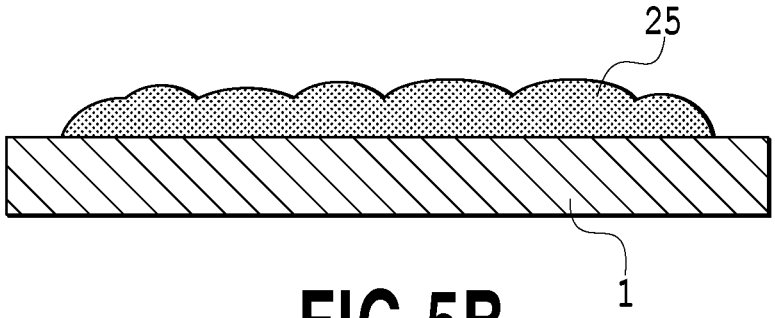

The present embodiment is characterized by focusing on differences in dot spread degree and dot height due to such a difference in contact angle among pigment inks to optimize an application order of the pigment inks. That is, in the multipass printing system, ejection of the pigment inks is distributed to a plurality of scans, and the pigment inks are ejected onto a predetermined area to print an image. At this time, pigment ink having a small contact angle easily wets and spreads on a print medium, and therefore dots of the ejected pigment ink often come into contact with each other. FIG. 5A illustrates a state of an image surface of a layer 25 of pigment ink having a relatively small contact angle on a print medium 1. A dot of the dropped pigment ink wets and spreads, so that the dot comes into contact and connects with simultaneously dropped surrounding dots and is therefore dried with having a low dot height. On the basis of this, the image surface of the layer 25 of the pigment ink having a relatively small contact angle is finished in a flat shape (smooth shape) even if a dot ejected by another scan is stacked. On the other hand, pigment ink having a relatively large contact angle is unlikely to wet or spread, and therefore ejected dots are less likely to come into contact with each other. FIG. 5B illustrates a state of an image surface of a layer 25 of pigment ink having a relatively large contact angle on the print medium 1. A dot of the dropped pigment ink does not wet or spread on the print medium, so that the dot does not come into contact or connect with simultaneously dropped surrounding dots, and is therefore dried with keeping a high dot height. On the basis of this, the image surface of the layer 25 of the pigment ink having a relatively large contact angle is finished in a concavo-convex shape as a result of the stack of a dot ejected by another scan.

FIG. 8B is a table listing values of surface shapes (surface roughness) for the cases of printing an image at an approximately 100% duty on glossy paper with the black and light cyan inks, respectively. Note that the duty here refers to an application ratio (%) of an ink dot to a predetermined area.

For example, in this specification, to apply one dot to a 1/1200 square (hereinafter referred to as "1200 dpi square") area is defined as a 100% duty.

A surface roughness value (Ra) of an image printed with the black ink having a relatively small contact angle was 79 nm, and a surface shape was smooth. Also, a surface roughness value of an image printed with the light cyan ink having a relatively large contact angle was 145 nm, resulting in a surface shape having a large concave-convex degree as compared with the black ink.

Figure 10:
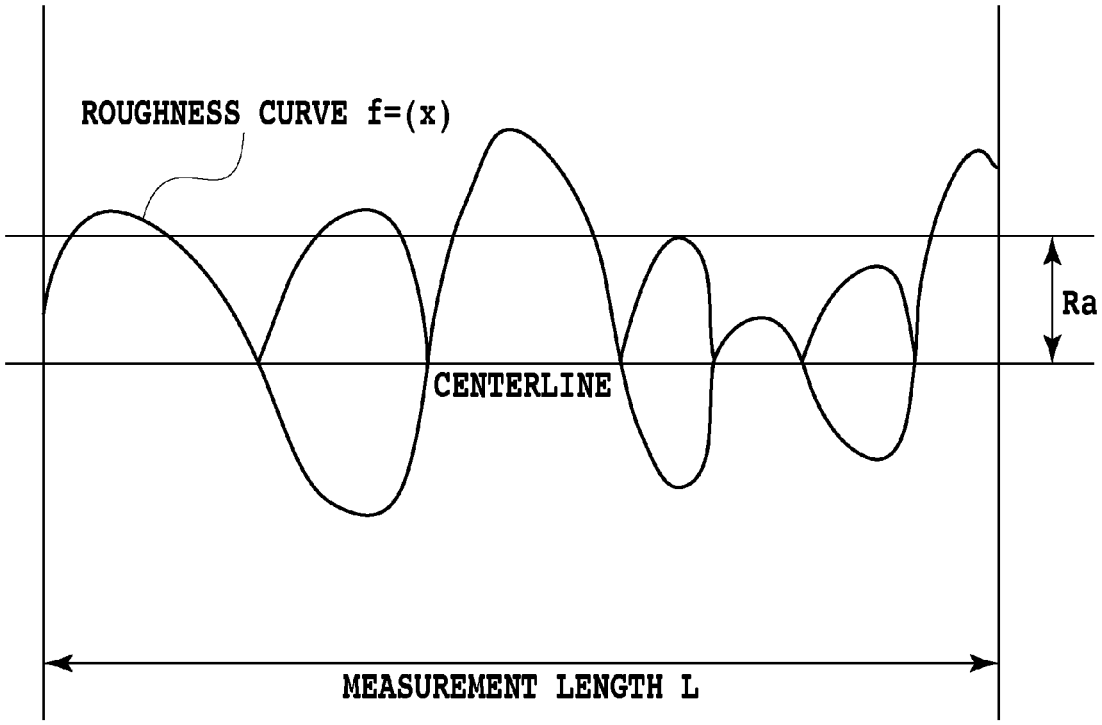
FIG. 10 is a diagram for explaining the surface roughness (Ra)

The surface roughness value used herein is described with use of FIG. 10. The surface roughness value (Ra) herein is referred to as a centerline average roughness value and corresponds to a length unit value that is obtained by folding back a roughness curve along a centerline and dividing an area between the folded roughness curve and the centerline by a measurement length L in a centerline direction. For the measurements, NANOSCALE HYBRID MICROSCOPE manufactured by Keyence Corporation was used. Note that as long as a surface roughness value of a pigment ink image surface can be measured, a measuring instrument is not limited to the above-exemplified one.

FIG. 8B further lists glossiness degrees and haze values for the cases of printing the image at an approximately 100% duty on the glossy paper with the black and light cyan inks, respectively. The image printed with the black ink having a relatively small contact angle has the smooth surface shape, and therefore has good glossiness. On the other hand, the image printed with the light cyan ink having a relatively large contact angle has the concavo-convex surface shape, which makes scattered reflected light intense or a specular image blurred, and thereby a reduction in glossiness occurs. The difference in image surface shape appears as a difference in glossiness, which gives rise to a problem of image performance such as gloss unevenness.

In this specification, the "glossiness" refers to a glossiness degree indicating brightness (light ratio) at the time when light irradiated to a surface of an object at a certain incident angle is specularly reflected, and also to a haze value indicating a viewable degree of an image of another object appearing on the surface. Regarding the glossiness degree, it is said that as a value of the degree is increased, a ratio of reflected specularly reflected light increases, resulting in higher gloss or better gloss. Also, regarding the haze value, as the value is increased, the image appearing is more hazily and unclearly viewed, and as the value is decreased, the image is more clearly viewed. Actual human eyes view the glossiness as a result of a correlation between the glossiness degree and the haze value. For example, in the case of the same haze values, one having a higher glossiness degree is felt better in glossiness. For measurements of them, micro-haze plus (20°) manufactured by BYK-Gardner GmbH was used. Note that as long as a surface glossiness of a pigment ink can be measured, a measuring instrument is not limited to the above-exemplified one.

In the present embodiment, the difference in dot spread due to the difference in contact angle between the above pigment inks is used to optimize the application order of the pigment inks respectively having different contact angles, and thereby a surface shape of an image printed with the pigment inks is approximately uniformed over a predetermined area to reduce gloss unevenness in the predetermined area. Here, the predetermined area may be, for example, a whole of a printed image, or apart of the printed image. That is, a relative size relationship in contact angle among the plurality of types of pigment inks used, and a relationship in application amount among the pigment inks are focused on to control ink ejection. In the case where an application amount of pigment ink having a relatively large contact angle is large, a surface shape is likely to have a larger concavo-convex degree, so that control is performed so as to apply pigment ink having a relatively small contact angle in last half scans, and thereby a surface of a printed image is smoothed. On the other hand, in the case where an application amount of pigment ink having a relatively small contact angle is large, a surface shape is likely to be smoother, so that control is performed so as to apply pigment ink having a relatively large contact angle in the last half scans to provide a concavo-convex shape to an image surface. As described, by optimizing an application order of the pigment inks respectively having different contact angles onto a predetermined area, image performance such as gloss unevenness in the predetermined area can be improved.

In characteristic control of the present embodiment, the plurality of types of pigment inks to be used are, depending on a difference in wettability (contact angle), preliminarily classified into large contact angle group inks (first inks) respectively having relatively large contact angles and small contact angle group inks (second inks) respectively having relatively small contact angles. In the this example, the light cyan (LC) and light magenta (LM) inks are classified as inks in the large contact angle group (first inks), and the black (K), cyan (C), magenta (M), and yellow (Y) inks are classified as inks in the small contact angle group (second inks). In a printing method of the present embodiment, control corresponding to each of the groups is performed.

(Configuration Example of Image Processing System)

Figure 3:
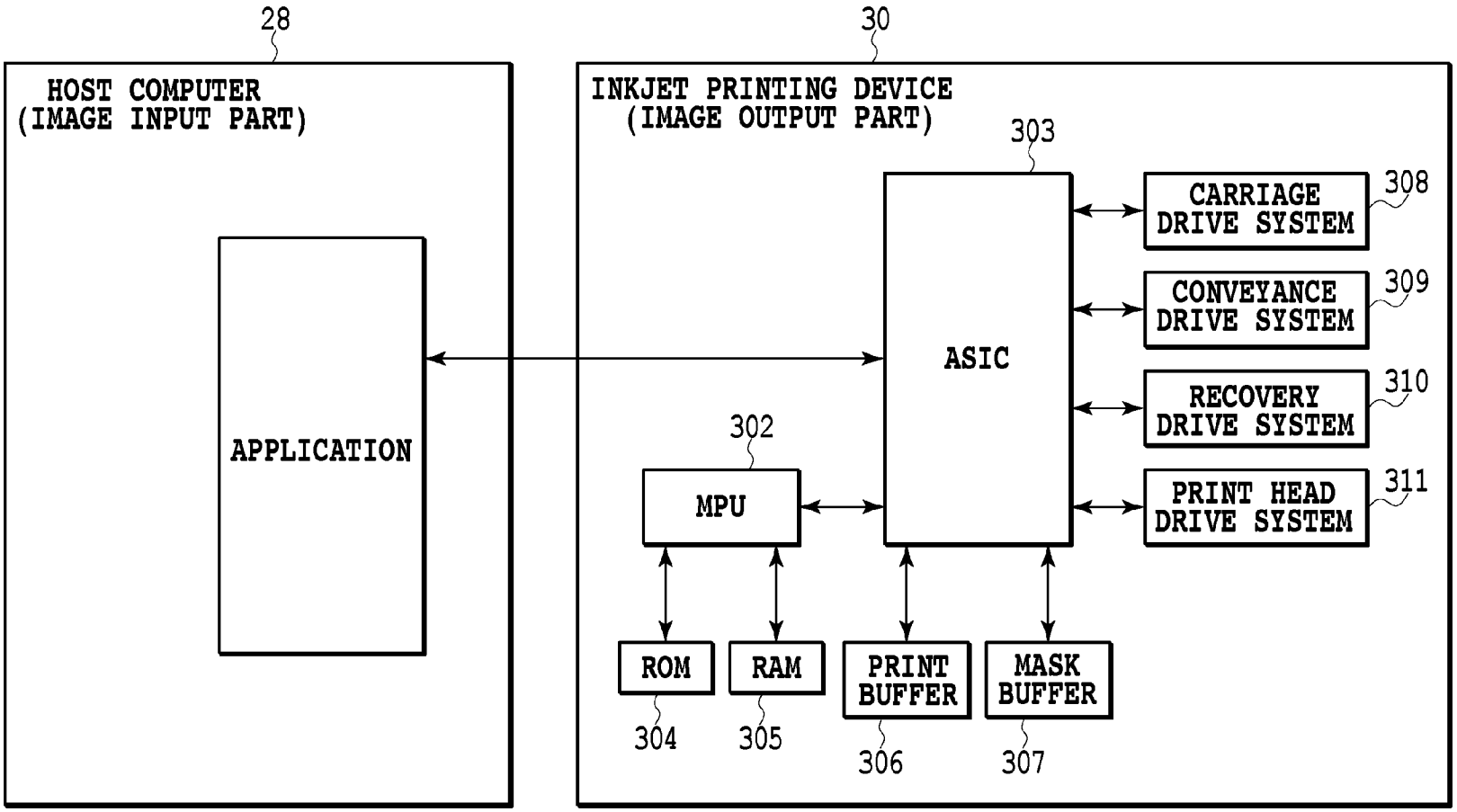
FIG. 3 is a diagram illustrating a schematic configuration of the inkjet printing device in the typical embodiment of the present invention.

FIG. 3 is a block diagram illustrating a configuration of a control system in the inkjet printing device that is a typical embodiment of the present invention. A host computer (image input part) 28 transmits RGB-formatted multivalued image data stored in a various types of storage media such as a hard disk to an image processing part inside the inkjet printing device. The image processing part is configured to include an after-mentioned MPU 302, ASIC 303, and the like. The multivalued image data can also be received from an image input device such as a scanner or digital camera connected to the host computer 28. The image processing part applies after-mentioned image processing to the inputted multivalued image data to convert it to binary image data. On the basis of this, pieces of binary image data (ejection data) for ejecting the plurality of types of pigment inks from the print head are generated. On the basis of the pieces of binary image data on at least two or more types of pigment inks, which are generated in the image processing part, the inkjet printing device (image output part) 30 applies the pigment inks onto a print medium to print an image. The image output part 30 itself is controlled by the MPU (Micro Processor Unit) 302 according to a program recorded in a ROM 304. A RAM 305 is used as a work area for the MPU 302 or a temporary data storage area. The MPU 302 controls a carriage drive system 308, print medium conveyance drive system 309, print head recovery drive system 310, and print head drive system 311 through the ASIC 303. Also, the MPU 302 is configured to be readable/writable from the ASIC 303 to a readable/writable print buffer 306. The print buffer 306 temporality stores image data that is converted to data having a format that can be transferred to the print head. A mask buffer 307 temporarily stores a predetermined mask pattern that, when image data is transferred from the print buffer 306 to the print head, performs AND-processing of the image data as necessary. In addition, a plurality of sets of mask patterns for an after-mentioned plurality of types of multipass printing respectively having different application orders are prepared in the ROM 304, and at the time of actual printing, a corresponding mask pattern is read from the ROM 304 and then stored in the mask buffer 307. In the present embodiment, the image processing part is present in the inkjet printer 30, but may be present in the host computer 28.

(Image Processing)

Figure 4B:
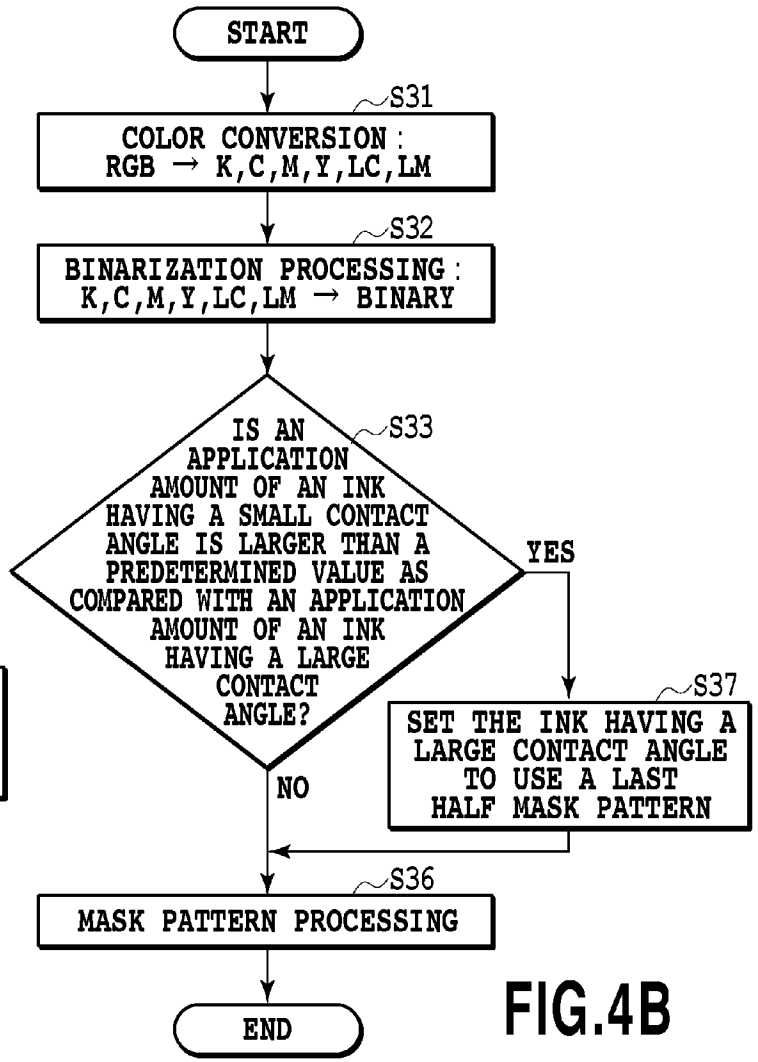
FIG. 4B is a flowchart for an image processing part in the second embodiment.
Figure 4A:
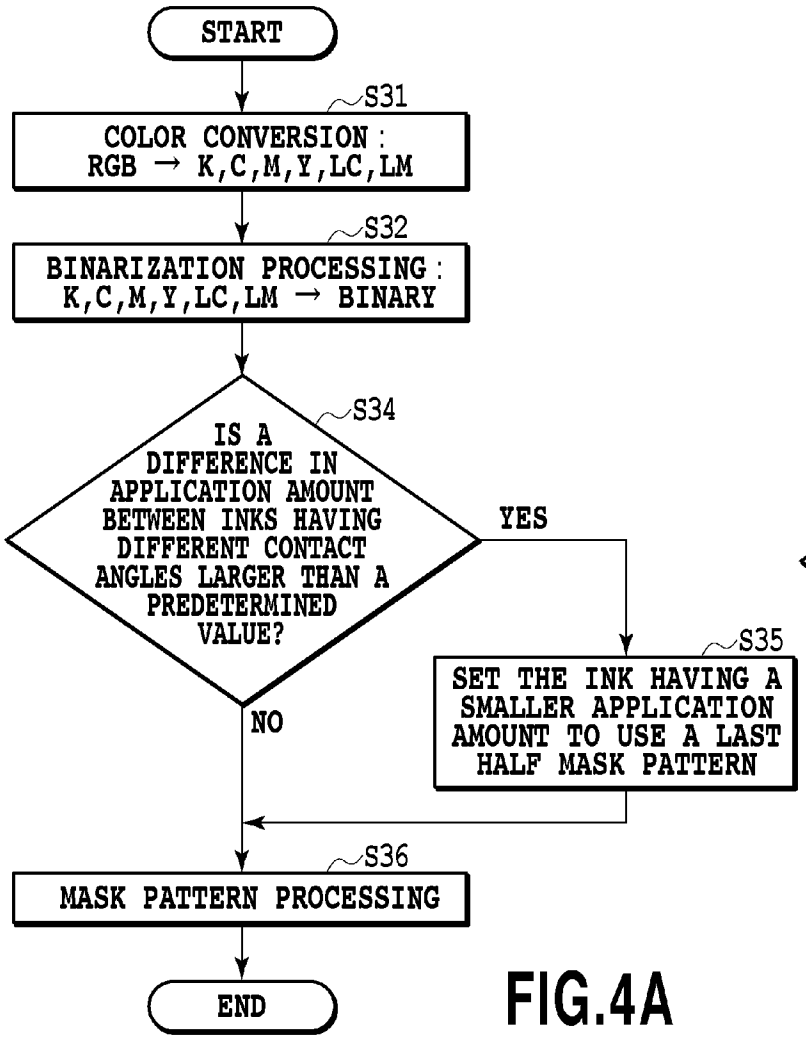
FIG. 4A is a flowchart for an image processing part in the first embodiment of the present invention.

Next, a method for generating pieces of ejection data for ejecting pigment inks respectively having different contact angles in the present embodiment is described with use of FIG. 4A. FIG. 4A is a flowchart for the above-described image processing part, and in the image processing part, the pieces of ejection data on the pigment inks are generated.

Specifically, first, pieces of RGB-formatted multivalued image data are inputted from the host computer (image input part) 28. The pieces of RGB-formatted multivalued image data are converted by color conversion in Step S31 to pieces of multivalued image data respectively corresponding to the plurality of types of inks (K, C, M, Y, LC, and LM) used for image printing. Then, in binarization processing in Step S32, according to a stored pattern, the pieces of multivalued image data corresponding to the respective types of inks are expanded to pieces of binary image data on the respective types of inks. On the basis of this, the pieces of binary image data respectively for applying the plurality of types of pigment inks are generated.

In Step S34, on the basis of the pieces of generated binary image data on the pigment inks, it is determined whether or not a difference between a sum of application amounts of the inks belonging to the large contact angle group and a sum of application amounts of the inks belonging to the small contact angle group in a predetermined area is larger than a predetermined value. If the difference is larger than the predetermined value, the flow proceeds to Step S35, where inks belonging to a contact angle group of which a sum of application amounts is smaller are set to use an after-mentioned "last half mask pattern". Thus, among a plurality of times of scans to eject an ink having a smaller application amount to a predetermined area of a print medium, the ratio an ink having a smaller application amount to be ejected in last half scans can be increased. More specifically, among a plurality of times of scans to eject an ink having a smaller application amount to a predetermined area of a print medium, the ratio an ink having a smaller application amount to be ejected in last half scans can be set greater than the ratio the ink having a smaller application amount to be ejected in first half scans, among a plurality of times of scans to eject the ink having a smaller application amount to the predetermined area of a print medium. For inks belonging to the other contact angle group, that is, for inks belonging to a contact angle group of which a sum of application amounts is larger, an after-mentioned "normal mask pattern" is used in subsequent Step S36. On the other hand, in Step S34, if the difference is smaller than the predetermined value, the flow proceeds to Step S36, where for both of the inks belonging to the large contact angle group and the inks belonging to the small contact angle group, the "normal mask pattern" is used. In Step S36, the pieces of binary image data on the plurality of types of pigment inks are generated as pieces of ejection data having a format transferable to the print head by mask pattern processing using the normal or last half mask pattern for distributing the pieces of binary image data to the plurality of scans.

The above-described flow is more specifically described. For example, in Step S32, it is assumed that an image in the predetermined area, which has been subjected to the binarization processing in Step S32, is configured to have approximately 100% duty light cyan ink belonging to the large contact angle group and approximately 10% duty black ink belonging to the small contact angle group. In this case, a difference between the duties (%) used to apply respective ink dots, that is, a difference in application ratio (%) of ink dot in the predetermined area is approximately 90% points. Note that an ejection amount of ink ejected from each of the ejection ports of the print head used in the present embodiment at one time is, as described with FIG. 2, approximately 4.5 ng, and the same for the respective colors. Accordingly, the difference in ink application amounts corresponds to a difference in application ratio, that is, a difference in duty, and is therefore approximately 90% points. If the predetermined value for a difference in ink application amount is 40% points, the difference in application amount is determined in Step S34 to be larger than the predetermined amount. Accordingly, the light cyan ink that has the smaller application amount and belongs to the large contact angle group is set to use the last half mask pattern in Step S35, and then, in Step S36, the mask pattern processing using the last half mask pattern is performed to generate the ejection data. On the other hand, regarding the black ink belonging to the small contact angle group, the mask pattern processing using the normal mask pattern is performed in Step S36 to generate the ejection data.

Also, it is assumed that the image is configured to have approximately 40% duty light cyan ink belonging to the large contact angle group and approximately 5% duty black ink belonging to the small contact angle group. In this case, the difference in application amount is approximately 35% points. If the predetermined value for a difference in ink application amount is 40% points, the difference in application amount is determined in Step S34 to be smaller than the predetermined amount. Accordingly, the light cyan ink belonging to the large contact angle group and the black ink belonging to the small contact angle group are both subjected to the mask pattern processing using the normal mask pattern in Step S36 to generate the pieces of ejection data.

Further, for example, it is assumed that the image is configured to have approximately 10% duty light cyan ink belonging to the large contact angle group and approximately 100% duty black ink belonging to the small contact angle group. In this case, the difference in application amount is approximately 90% points. If the predetermined value for a difference in ink application amount is 40% points, the difference in application amount is determined in Step S34 to be larger than the predetermined amount. In Step S35, the light cyan ink that has the smaller application amount and belongs to the large contact angle group is set to use the last half mask pattern, and in Step S36, the mask pattern processing using the last half mask pattern is performed to generate the ejection data. On the other hand, regarding the black ink belonging to the small contact angle group, in Step S36, the mask pattern processing using the normal mask pattern is performed to generate the ejection data.

On the basis of the pieces of ejection data generated as described, the pigment inks are ejected from the print head of the inkjet printing device (image output part) 30 according to the after-mentioned multipass printing system, and thereby the image is printed in the predetermined area.

(Printing Operation)

Printing operation that performs the above-described characteristic control of the present embodiment in the printing device having the above configuration is described. Note that the "characteristic control" refers to, in the case where a difference between an application amount of pigment ink having a large contact angle and an application amount of pigment ink having a small contact angle is larger than the predetermined value, controlling the pigment ink application order so as to, in the last half scans, apply pigment ink having a contact angle of which an application amount is smaller. In the present embodiment, the multipass printing system that uses eight scans in total to print an image with the pigment inks for each predetermined area is employed.

Figure 11:
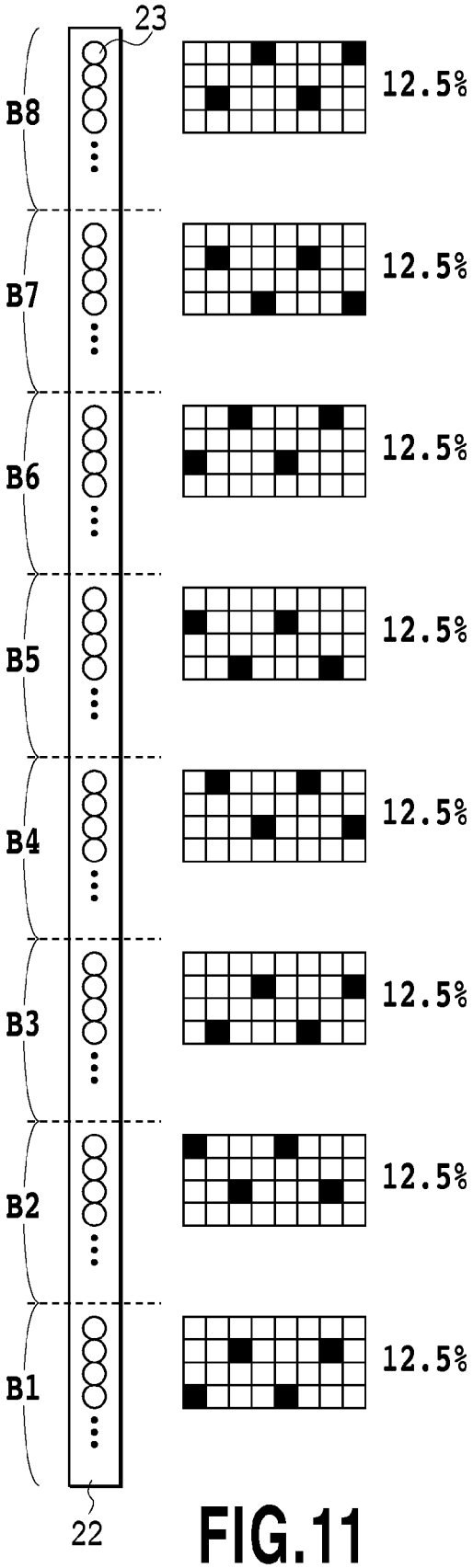
FIG. 11 is a diagram for explaining a mask pattern for the case of applying pigment inks used in the embodiment of the present invention.
Figure 12A:
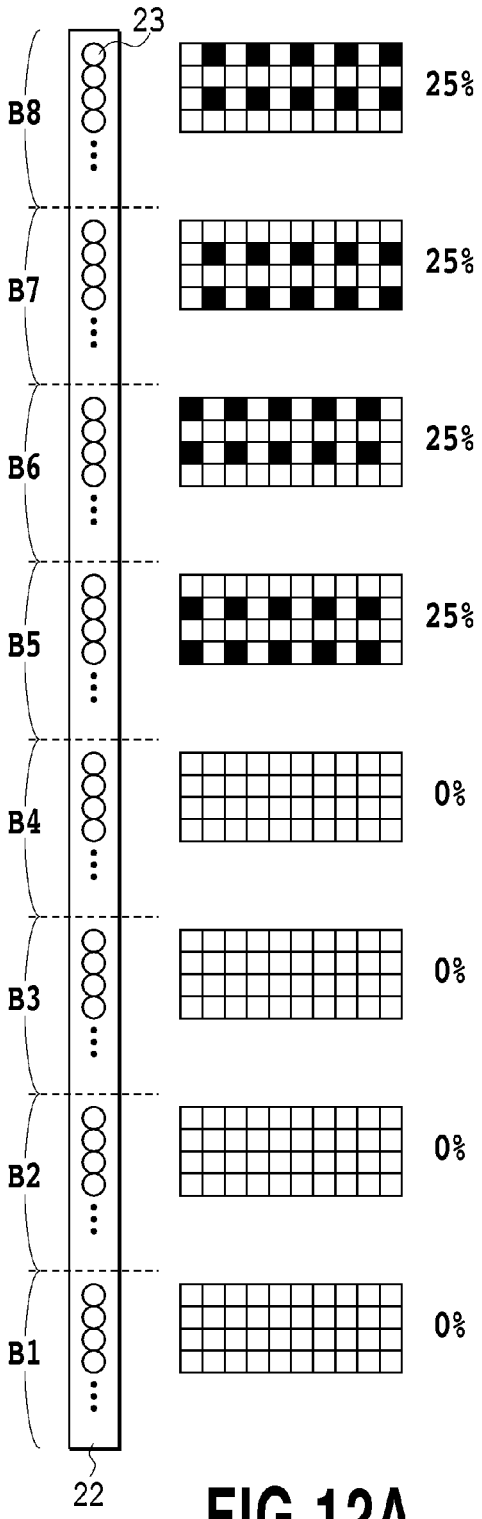
FIGS. 12A and 12B are diagrams for explaining mask patterns for the case of performing printing in last half scans.

FIG. 11 illustrates the "normal mask pattern" used in the present embodiment, that is, a mask pattern that uniformly distributes an ink application amount to the total eight print head scans on the 12.5% basis. Also, FIG. 12A illustrated the "last half mask pattern" used in the present embodiment. The "last half mask pattern" is a mask pattern in the case of which, among the total eight scans, in the first four scans, ink is not ejected, but only in the last half four scans including the last scan, the ink is ejected to all pixels. That is, in this example, a distribution ratio of an ink application amount in each of the first half four scans among the plurality of print head scans is 0%, and that of an ink application amount in each of the last half hour scans is 25%. For example, the above-described example where the image in the predetermined area is configured to have the approximately 10% duty light cyan ink belonging to the large contact angle group and the approximately 100% duty black ink belonging to the small contact angle group, and the different in application amount is approximately 90% points is used. If the predetermined value is 40% points, in above-described Step S34, the difference in application amount is determined to be larger than the predetermined value. In Step S35, the light cyan ink that has the smaller application amount and belongs to the large contact angle group is set to use the last half mask pattern. On the other hand, the black ink belonging to the small contact angle is set to use the normal mask pattern in Step S36. As described, a surface shape is likely to be smooth because the application amount of the black ink is large; however, by concentrating the ejection of the light cyan ink having the smaller application amount on the last four scans, an effect of making the surface shape concave-convex is produced. In the following, description is provided along this embodiment.

Figure 6:
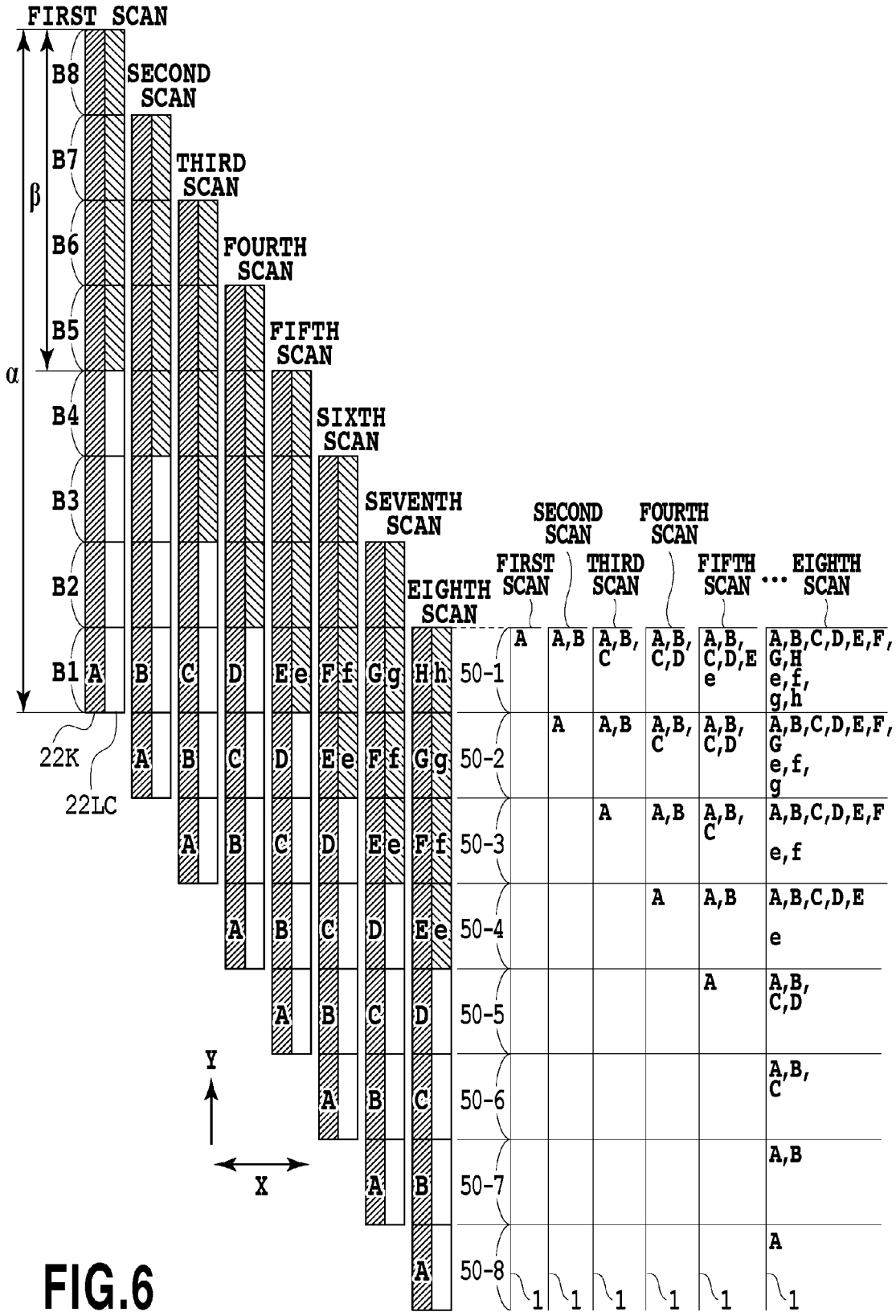
FIG. 6 is an explanatory diagram of a printing method in the first embodiment of the present invention.

FIG. 6 is an explanatory diagram of a method for printing an image area that is printed with the black ink ejected through the normal mask pattern and the light cyan ink ejected through the last half mask pattern. Each of the print head 22K for ejecting the black (K) ink and the print head 22LC for ejecting the light cyan (LC) ink has the 1280 ejection ports, which are equally divided into eight blocks B1, B2, B3, B4, B5, B6, B7, and B8 each having 160 ports. In the print head 22K, the 1280 ejection ports in the range α from the block B1 to the block B8 (see FIG. 2A) are used. In the following, the ejection ports in the blocks B1 to B8 are also referred to as the ejection ports in A, B, C, D, E, F, G, and H areas, respectively. In the print head 22LC, the 640 ejection ports in the range α from the block B5 to the block B8 (see FIG. 2A) are used. In the following, the ejection ports in the blocks B5 to B8 are also referred to as the ejection ports in e, f, g, and h areas, respectively. In FIG. 6, 50-1, 50-2, 50-3, . . . , or 50-8 represents a print area on the print medium, which corresponds one block of a print head.

First, in the first scan, on the basis of pieces of ejection data for the first scan over the print area 50-1, the ink is ejected from the ejection ports in the A area of the print head 22K.

Then, the print medium 1 is conveyed in the sub scanning direction (direction indicated by an arrow Y) by a length equal to ⅛ of the print head. In FIG. 6, the print head is presented as one that moves relative to the print medium 1 in the main scanning direction (direction indicated by X) that is a direction intersecting with the sub scanning direction. In the subsequent second scan, on the basis of pieces of ejection data for the second scan over the print area 50-1, the ink is ejected from the ejection ports in the B area of the print head 22K. During the second scan, the first scan over the print area 50-2 is performed.

Then, the print medium 1 is conveyed in the sub scanning direction by the length equal to ⅛ of the print head. In the subsequent third scan, on the basis of pieces of ejection data for the third scan over the print area 50-1, the ink is ejected from the ejection ports in the C area of the print head 22K. During the third scan, the second scan over the print area 50-2 and the first scan over the print area 50-3 are performed.

Then, the print medium 1 is conveyed in the sub scanning direction by the length equal to ⅛ of the print head. In the subsequent fourth scan, on the basis of pieces of ejection data for the fourth scan over the print area 50-1, the ink is ejected from the ejection ports in the D area of the print head 22K. During the fourth scan, the third scan over the print area 50-2, the second scan over the print area 50-3, and the first scan over the print area 50-4 are performed.

Then, the print medium 1 is conveyed in the sub scanning direction by the length equal to ⅛ of the print head. In the subsequent fifth scan, on the basis of pieces of ejection data for the fifth scan over the print area 50-1, the ink is ejected from the ejection ports in the E area of the print head 22K. At the same time, the ink is ejected from the ejection ports in the e area of the print head 22LC. During the fifth scan, the fourth scan over the print area 50-2, the third scan over the print area 50-3, the second scan over the print area 50-4, and the first scan over the print area 50-5 are performed.

Then, the print medium 1 is conveyed in the sub scanning direction by the length equal to ⅛ of the print head. In the subsequent sixth scan, on the basis of pieces of ejection data for the sixth scan over the print area 50-1, the ink is ejected from the ejection ports in the F area of the print head 22K. At the same time, the ink is ejected from the ejection ports in the f area of the print head 22LC. During the sixth scan, the fifth scan over the print area 50-2, the fourth scan over the print area 50-3, the third scan over the print area 50-4, the second scan over the print area 50-5, and the first scan over the print area 50-6 are performed. Also, at the same time, the ink is ejected to the print area 50-2 from the ejection ports in the e area of the print head 22LC.

Then, the print medium 1 is conveyed in the sub scanning direction by the length equal to ⅛ of the print head. In the subsequent seventh scan, on the basis of pieces of ejection data for the seventh scan over the print area 50-1, the ink is ejected from the ejection ports in the G area of the print head 22K. At the same time, the ink is ejected from the ejection ports in the g area of the print head 22LC. During the seventh scan, in the same manner as that described above, the sixth scan to the first scan respectively over the print areas 50-2 to 50-7 are performed. Also, at the same time, the ink is ejected to the print area 50-2 from the ejection ports in the f area of the print head 22LC, and to the print area 50-3 from the ejection ports in the e area of the print head 22LC.

Then, the print medium 1 is conveyed in the sub scanning direction by the length equal to ⅛ of the print head. In the subsequent eighth scan, on the basis of pieces of ejection data for the eighth scan over the print area 50-1, the ink is ejected from the ejection ports in the H area of the print head 22K. At the same time, the ink is ejected from the ejection ports in the h area of the print head 22LC. During the eighth scan, the seventh scan to the first scan respectively over the print areas 50-2 to 50-8 are performed. Also, at the same time, in the same manner as that described above, the ink is ejected to the print areas 50-2 to 50-4 respectively from the ejection ports in the g to e areas of the print head 22LC.

By such first to eight scans, image printing in the print area 50-1 with the black (K) ink is completed, and by such fifth to eighth scans, image printing in the print area 50-1 with the light cyan (LC) ink is completed.

By repeating similar scans, image printing in the print areas 50-2, 50-3, . . . is completed in a sequential manner.

As described, depending on a contact angle of pigment ink and an application amount of the ink, a printing method that applies pigment inks respectively having different contact angles can be preferably varied. Specifically, first, a difference in application amount between pigment ink (first ink) having a relatively large contact angle and pigment ink (second ink) having a relatively small contact angle is obtained. If the difference is larger than the predetermined value, the pigment ink application order is controlled so as to, in the last half scans, apply pigment ink of which an application amount is smaller. According to this, even in the case of using pigment inks respectively having different contact angles to print an image, a surface shape of the image can be uniformed, and therefore image performance such as gloss unevenness can be improved.

The predetermined value for a difference in application amount of pigment ink in the present embodiment can be appropriately set depending on pigment inks used, and glossiness and a degree of gloss unevenness of a desired image.

Figure 12B:
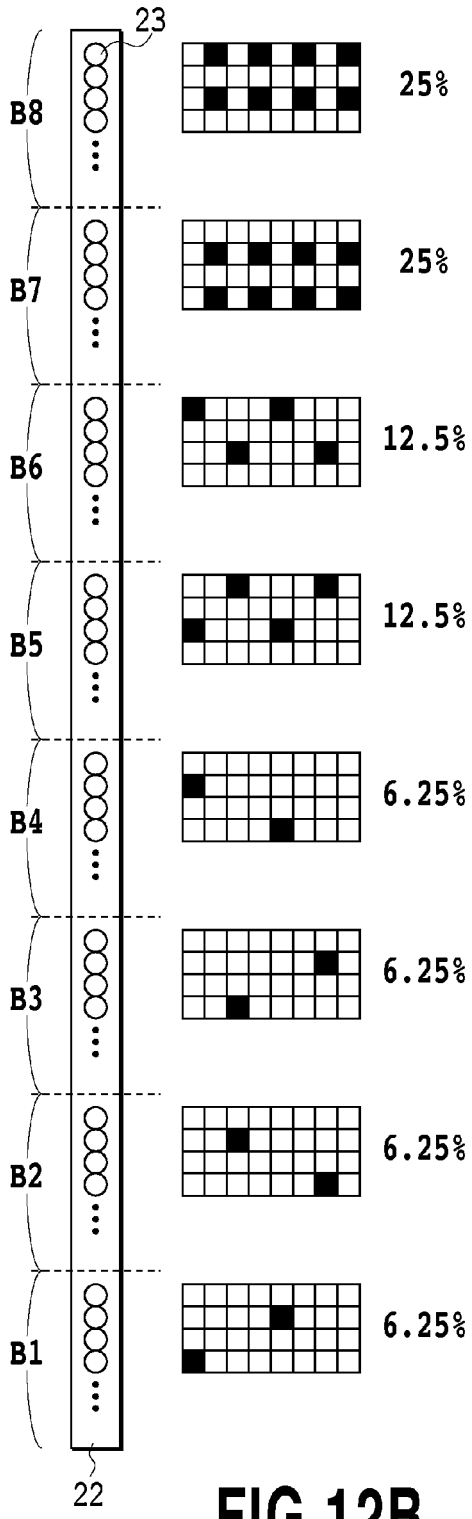

In the present embodiment, with use of the mask pattern illustrated in FIG. 12A, the light cyan (LC) ink is ejected in the four scans including the last scan among the plurality of scans to thereby print an image. However, in the present invention, pigment ink having a relatively small application amount among the plurality of pigment inks is only required to have a high ratio of an application amount applied in the last half scans among the plurality of scans. For example, as a mask pattern illustrated in FIG. 12B, a mask pattern in the case of which pigment ink is ejected in all of the total eight scans and ratios of application amounts ejected in the last half scans are higher may be used. Also, in the present invention, the number of scans to apply pigment ink to a predetermined area is not limited. In the present embodiment, as a method for distributing pieces of ejection data on the pigment inks so as to print an image with a smaller number of scans, the mask patterns are used; however, the present invention may employ another distribution method.

Also, in the present embodiment, it is assumed that the image in the predetermined area is configured to have the light cyan and black inks, and the predetermined value for the difference in application amount is set to the 40% points. However, in the present invention, in addition to the types and application amounts of pigment inks, depending on a sum of application amounts, image intensity, image gradations, or the like, the predetermined value may be varied. Ratios of application amount, the number of scans, or the like for the application in the last half scans may be varied depending on the types of pigment inks.

Further, in the present embodiment, in the case where the difference in application amount between pigment inks respectively having different contact angles is larger than the predetermined value, pigment ink having a contact angle leading to a smaller application amount is applied in the last half scans, and thereby control is performed to achieve a surface shape that reduces gloss unevenness. However, depending on a combination of a plurality of types of pigment inks, glossiness may be uniformed to be any of high glossiness and low glossiness to reduce gloss unevenness. For example, in the case of reducing gloss unevenness with keeping high glossiness, if an application amount of pigment ink having a large contact angle is larger than the predetermined value as compared with an application amount of pigment ink having a small contact angle, it is only necessary to apply the pigment ink having a small contact angle in the last half scans. On the other hand, in the case of reducing gloss unevenness with keeping low glossiness, if an application amount of pigment ink having a small contact angle is larger than the predetermined value as compared with an application amount of pigment ink having a large contact angle, it is only necessary to apply the pigment ink having a large contact angle in the last half scans.

Still further, in the present embodiment, among the pigment inks used for image printing, the light cyan ink or light magenta ink that improves image performance (in the present embodiment, scratch resistance) is used as ink having a large contact angle. However, separately from ink, approximately clear and colorless processing liquid having an image performance improving property may be added. In this case, preferably, the processing liquid is also controlled in terms of application order as one of inks respectively having contact angles. In the present embodiment, the pigment inks are classified into the large contact angle group and the small contact angle group to control the application order; however, in addition to the pigment inks, the processing liquid may be included to make the classification. In the case where the processing liquid is one that improves the scratch resistance, the processing liquid is preferably applied over a whole area of a printed image; however, an application range is not limited.

<Second Embodiment>

In the above-described embodiment, the application order of the pigment inks respectively having different contact angles is optimized according to an application amount of each of the pigment inks, and a surface shape of an image printed with the pigment inks is controlled to thereby improve image performance such as gloss unevenness. In the present embodiment, described are further effects in a configuration where, after an image has been printed with the pigment inks, processing liquid having an image performance improving property is applied to thereby cover the ink image.

The application order of the pigment inks respectively having large contact angles and the pigment inks respectively having small contact angles is the same as that in the above-described embodiment, and therefore a method for printing the pigment inks in the present embodiment is the same as that in the above-described embodiment illustrated in FIG. 6. Also, an application amount of the processing liquid in the present embodiment is assumed to be uniform over a whole area of an image printed with the pigment inks regardless of the number of dots of the pigment inks. Further, regarding the same parts as those in the above-described embodiment, description is omitted.

(Overall Configuration)

Figure 2B:
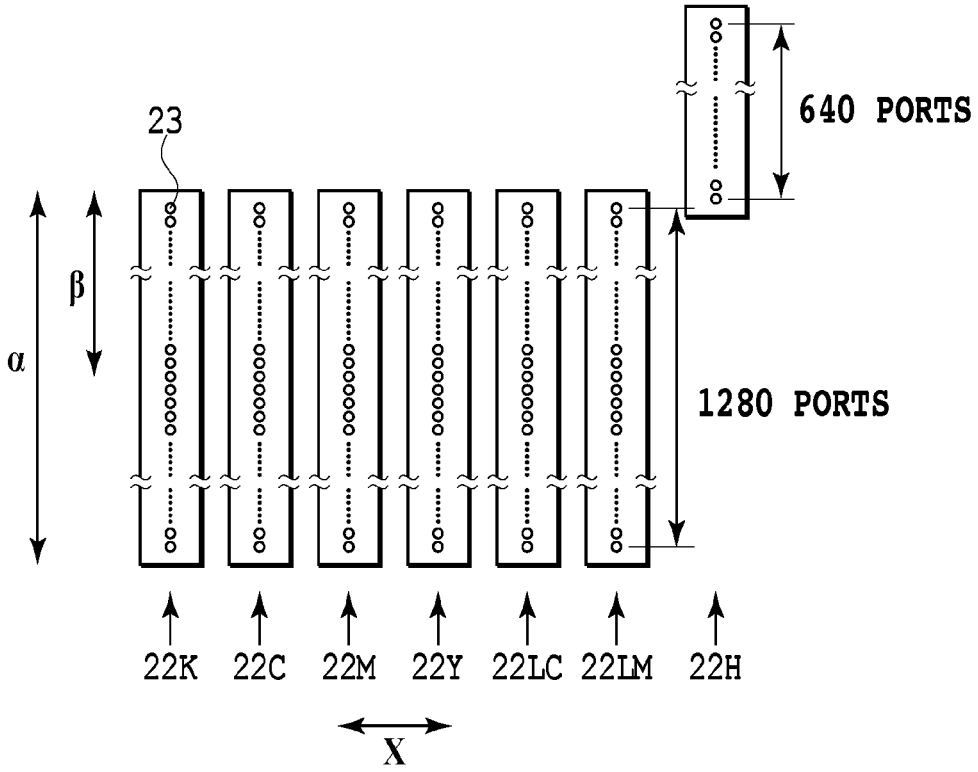
FIG. 2B is a diagram of a print head used in a second embodiment as viewed from an ejection port side.

An overall configuration of an inkjet printing device in the second embodiment of the present invention is described. In the present embodiment, the print head 22 illustrated in FIG. 1 is, in addition to the print heads 22K, 22C, 22M, . . . , 22LM respectively for the pigment inks, configured to be further provided with an unillustrated print head 22H for the processing liquid. The processing liquid is ejected to the print medium 1 from ejection ports provided in the print head 22H for the processing liquid to thereby perform printing. Similarly, an ink tank 21H for the processing liquid, and a cap 20H for the processing liquid are further provided. FIG. 2B is a diagram of the print head 22 as viewed from the ejection ports. The print head 22 is configured to add the print head 22H for the processing liquid to the print head used in the above-described embodiment with the print head 22H being displaced in a direction (e.g., sub scanning direction) intersecting with the main scanning direction X. In the print head 22H, 640 ejection ports are arrayed at a density of 1200 dpi that is the same as those for the pigment inks.

(Composition of Processing Liquid)

Next, a composition of the processing liquid used in the present embodiment is described.

[Processing Liquid]

(1) Preparation of Processing Liquid

The following constituents are mixed and sufficiently stirred to prepare the processing liquid.

| | |
|---|---|
| Acrylic silicone copolymer (product name: Symac US-450 manufactured by Toagosei Co., Ltd.) | 5 portions |
| Glycerin | 5 portions |
| Ethylene glycol | 15 portions |
| Acetylene glycol EO adduct (manufactured by Kawaken Fine Chemicals Co., Ltd) | 0.5 portions |
| Ion-exchanged water | 74.5 portions |

In the processing liquid of the present embodiment, the same resin material used for the light cyan or light magenta ink that is "ink having a relatively large contact angle" is contained. Here, the acrylic silicone copolymer (product name: Symac US-450 manufactured by Toagosei Co., Ltd.) that is a compound having slidability is used. Any material can be used if the material is a resin material that can form a transparent layer on an uppermost surface of a pigment ink layer and, in the present embodiment, improve the scratch resistance in the image fastness.

(Characteristic Configuration)

The present embodiment is configured to, with use of the processing liquid that is extremely effective in improving the scratch resistance in the image fastness, form a transparent layer as a surface layer for a pigment ink layer to covert an image. However, in such a transparent layer formed by the processing liquid, the above-described interference color unevenness due to the thin film interference phenomenon may occur, and therefore the interference color unevenness should be reduced.

Figure 5C:
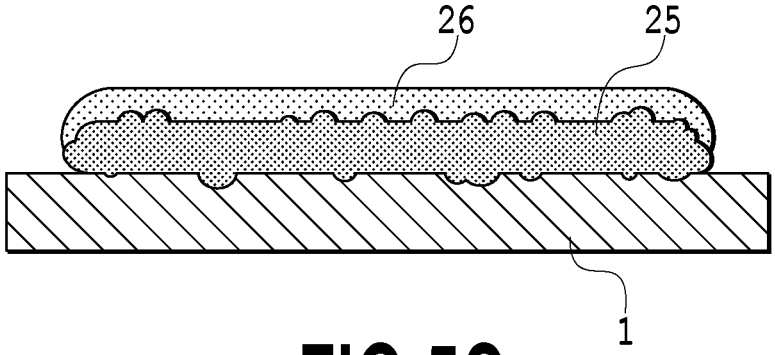
FIG. 5C is a diagram schematically illustrating a cross section of a printed image that is formed with a transparent layer with use of processing liquid.

FIG. 5C is a schematic diagram of an image cross section at the time when on the pigment ink layer 25 on the print medium 1, the transparent layer 26 based on the processing liquid is formed. The transparent layer is typically a transparent thin film having a thickness of approximately 100 nm to 500 nm. In such a transparent thin film, interference color is likely to occur.

The interference color of a transparent thin film is color that develops as a result of interference that occurs between light that is reflected by a surface of the transparent thin film and light that passes through the surface of the film and is reflected by aback side of the film to mutually increase or cancel light intensity. A mechanism to give rise to the interference color is described below in detail with use of FIG. 13.

Figure 13:
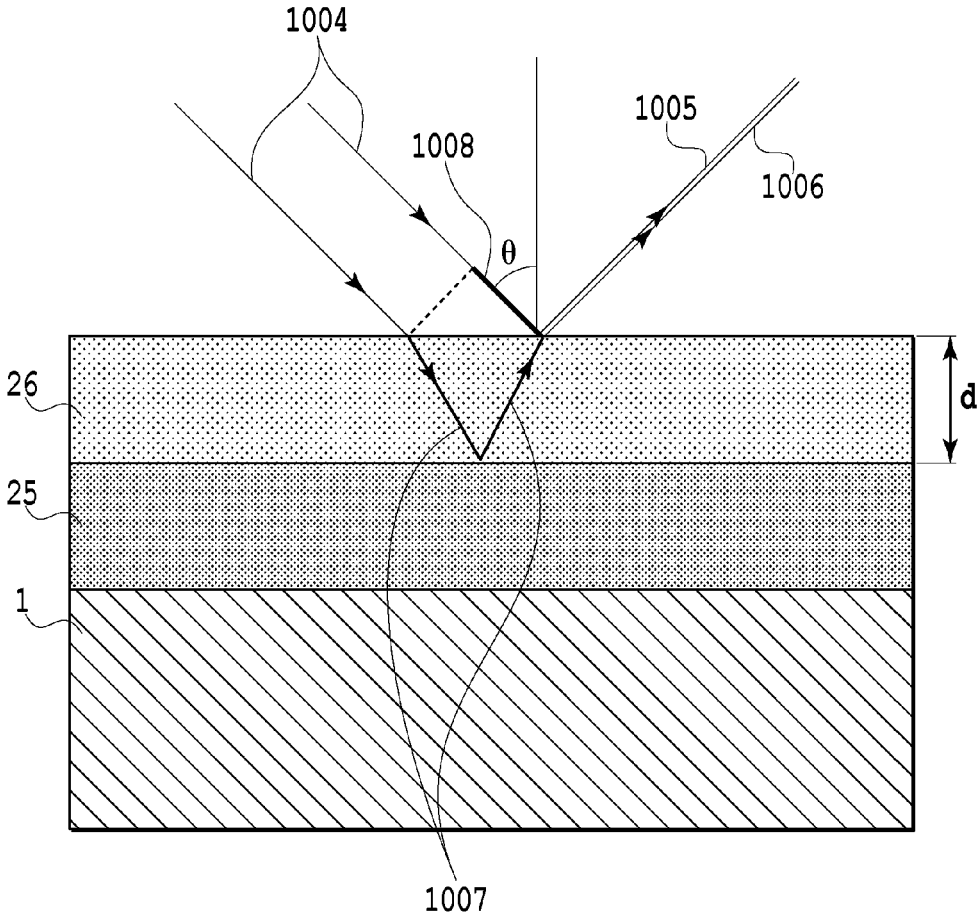
FIG. 13 is a diagram for explaining a mechanism of interference color.

FIG. 13 is a schematic cross-sectional view of an image that is, after an image has been printed with the pigment inks, formed with the transparent layer based on the processing liquid. Reference numeral 1 represents a print medium, 25 a pigment ink layer, and 26 the transparent layer. Reference numeral 1004 represents a direction from which light enters, and 1005 and 1006 represent a direction to which light exits after reflection. Reference numeral 1005 also represents light that is reflected by a surface, and 1006 represents light that is reflected between the transparent layer 26 and the pigment ink layer 25 and then exits.

In this case, between light indicated by a solid line 1007 and light indicated by a solid line 1008, an optical path difference occurs, and on the basis of a relationship between a distance of the optical path difference and a wavelength of the light, the lights mutually increase or decrease intensity.

In this case, generally, the following expression holds:

$$m*\lambda=n*2d*\cos\theta+\lambda/2 \quad (2)$$

Here, m represents an integer, n a refractive index of the transparent layer, d a thickness of the transparent layer, and θ an incident angle. The lights having the wavelength λ meeting this condition mutually increase intensity to intensively develop color.

A table below lists appearances of interference color for the case of applying the processing liquid after applying the cyan ink. In this case, an application amount of the cyan ink is a 100% duty, and an application amount of the processing liquid is as listed in Table 1. In this specification, as with the application amount of the pigment ink, the application amount of the processing liquid is also presented as a duty, that is, an application ratio (%) of a processing liquid dot to a predetermined area. In addition, in this examination, as the print medium, photo glossy paper (product name: Photo glossy paper [thin type] LFM-GP421RJ) manufactured by Canon Inc. was used. As the printing operation, the multipass printing system using eight scans in total was employed, and the pigment ink was first applied, and then the processing liquid was applied.

TABLE 1

Application amount of processing liquid and interference color

| Application amount of processing liquid (duty (%)) | Interference color |
|---|---|
| 10% | None |
| 25% | Blue |
| 50% | Green |
| 70% | Yellow |
| 90% | Reddish yellow |
| 110 % | Red |

As listed in Table 1, in the case where the application amount of the processing liquid is small, no interference color appears. This is because a wavelength range meeting Expression (2) is not present in a visible light range. As the application amount of the processing liquid is increased, a wavelength giving rise to interference color increases according to a thickness.

As described, regarding the light entering the pigment ink layer, its reflected light has a color shade. For this reason, light from a fluorescent lamp, or the like, appearing on an image does not have natural white reflected color but interference color, on the basis of which interference color unevenness occurs. Such interference color is changed depending on a thickness of the transparent layer, so that not only the interference color unevenness occurs but also spectral hues may appear, and thereby image quality is deteriorated.

As an effective means configured to suppress such interference color, there is a method that forms a transparent layer made of an extremely thin film. However, the effects such as improvement of glossiness and improvement of scratch resistance may not be obtained because a thickness of the transparent layer is too thin. Further, there is also a method that increases a thickness of the transparent layer. However, in this method, interference occurs at a number of wavelengths of light, and thereby color shades can be canceled; however, there is a possibility that the processing liquid should be applied more than necessary. For example, in the case of using the processing liquid to improve the scratch resistance, it is sufficient that the transparent layer has a thickness of approximately 200 nm, whereas a thickness that cancels interference color is approximately 1 μm, and therefore the application amount of the processing liquid is approximately quintupled. For this reason, in the present embodiment, by making a thickness of the transparent layer have variation, that is, by making a concavo-convex degree of a lower surface of the transparent layer larger (making the lower surface concavo-convex), a means configured to vary an interference wavelength to thereby suppress interference color is used. Specifically, in the case where an upper surface of the pigment ink layer is smooth (highly glossy), a thickness of the transparent layer becomes uniform, and therefore a specific interference color occurs. On the other hand, in the case where the upper surface of the pigment ink layer is concavo-convex (poorly glossy), the thickness of the transparent layer has variation, and therefore interference color is suppressed. Accordingly, by setting a concavo-convex degree of the upper surface of the pigment ink layer within a predetermined range, gloss unevenness of an image can be reduced, and also interference color caused by the transparent layer can be suppressed.

Figure 14A:
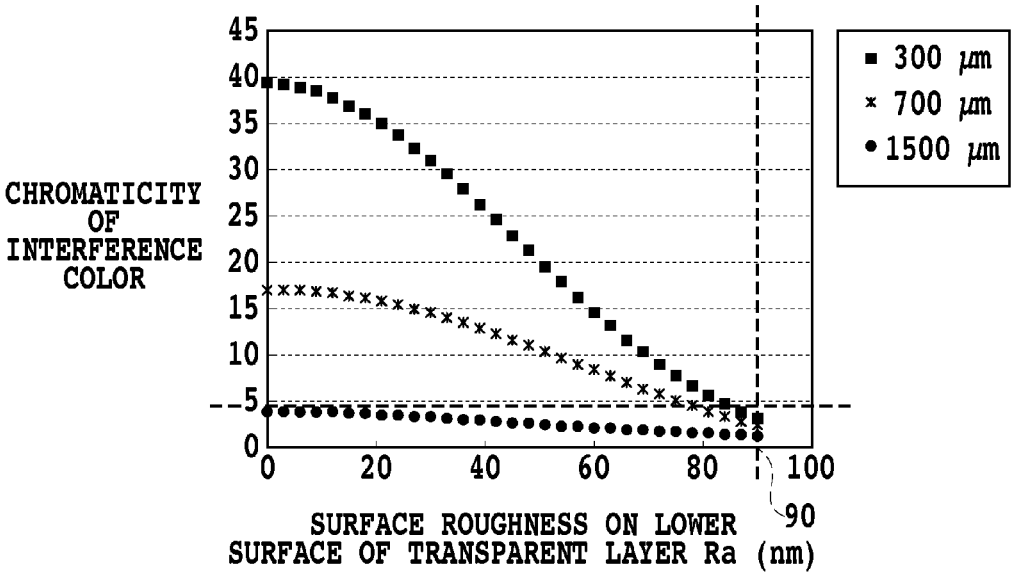
FIG. 14A is a diagram presenting a relationship between a surface roughness value (Ra) and interference color (chromaticity) in the second embodiment of the present invention.

FIG. 14 is a result of simulating whether or not what level of a surface roughness value (Ra) on the lower surface of the transparent layer suppresses interference color. As the surface roughness value on the lower surface of the transparent layer is varied, how an intensity (chromaticity) value of the interference color changes is illustrated in the graph. Note that, in the present embodiment, the surface roughness value (Ra) on the lower surface of the transparent layer is equivalent to a surface roughness value (Ra) on the upper surface of the pigment ink layer provided just under the transparent layer. As the chromaticity numerical value decreases, the interference color is made achromatic, and if the chromaticity value of the interference color becomes equal to or less than approximately 5, it is determined that there is visually no problem. It turns out that, in the case where the thickness of the transparent layer is set to 300, 700, or 1500 μm, if the surface roughness value (Ra) becomes equal to or more than approximately 90 nm, the chromaticity value of the interference color becomes equal to or less than approximately 5. In addition, as the interference color measurements, in the present examination, the chromaticity values were measured by SPECTRORADIOMETER CS-2000A manufactured by Konica Minolta. Note that as long as the interference color of the transparent layer can be measured, a measuring instrument is not limited to the above-exemplified one.

Figure 14B:
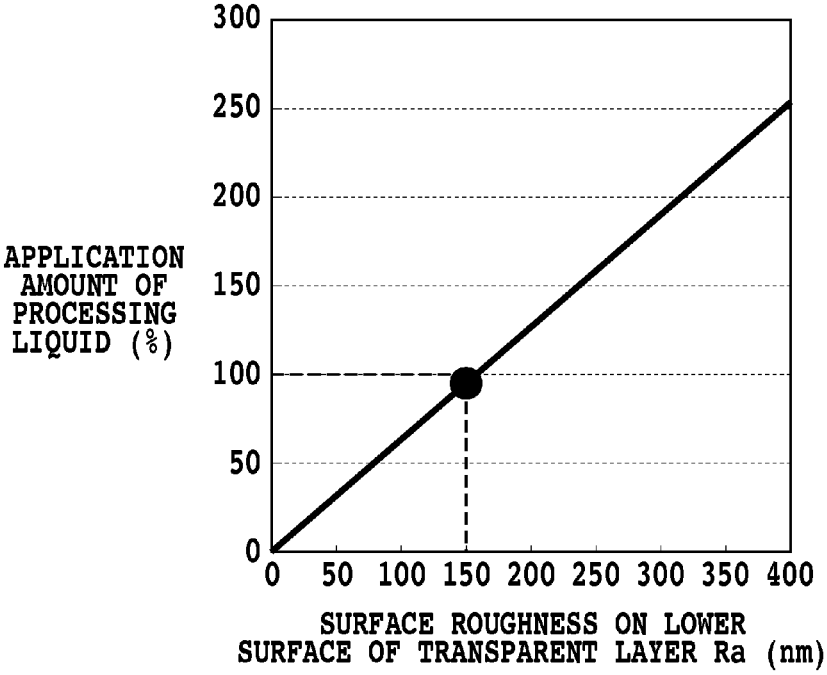
FIG. 14B is a diagram for explaining a relationship between the surface roughness value (Ra) and a processing liquid application amount (duty (%)).

Also, FIG. 14B is a result of simulating whether or not what degree of the surface roughness value (Ra) on the lower surface of the transparent layer can smooth a surface (upper surface) of the transparent layer, that is, can achieve high glossiness. The processing liquid application amount that makes the upper surface of the transparent layer smooth is illustrated in the graph depending on the surface roughness value on the lower surface of the transparent layer. In the present embodiment, if any condition within a range on an upper side of a plotted line is met, the upper surface of the transparent layer has a level that can be said to be smooth. It turns out that, for example, in the case where the application amount of the processing liquid is a 100% duty, if the surface roughness value (Ra) on the lower surface of the transparent layer is equal to or less than approximately 150 nm, the upper surface of the transparent layer is smooth and highly glossy.

It turns out from the above that in this simulation, in the case where the lower surface of the transparent layer has a surface roughness value (Ra) within a range of approximately 90 to approximately 150 nm, the highly glossy transparent layer having no interference color can be obtained. Note that a preferable surface roughness value (Ra) on the lower surface of the transparent layer is varied depending on the type of the processing liquid or a shape forming the surface roughness, and therefore not limited to the above numerical range.

As described, by using the difference in dot spread due to the difference in contact angle among pigment inks to optimize the application order of the pigment inks respectively having different contact angles, a surface shape of a pigment ink image is appropriately made concave-convex, and thereby interference color unevenness of the transparent layer formed by the processing liquid can be reduced.

In the case of the light cyan ink used in the present embodiment, as illustrated in FIG. 8B, the surface roughness value (Ra) on the upper surface of the pigment ink layer, that is, the surface roughness value (Ra) on the lower surface of the transparent layer is 145 nm. This surface roughness value falls within the predetermined surface roughness range (Ra is from approximately 90 to approximately 150 nm) that is obtained by the above-described simulation and enables the highly glossy transparent layer having no interference color to be formed. However, in the case of the black ink, the surface roughness value (Ra) is 79 nm, and falls below the above-described range, and therefore interference color may occur. Accordingly, regarding the black ink, it is necessary to increase a concavo-convex degree of a surface of an image printed with the black ink (make the surface concavo-convex). For this purpose, depending on a difference in application amount between the light cyan ink having a large contact angle and the black ink having a small contact angle, the application order of the inks is varied. In the case where the application amount of the light cyan ink having a large contact angle is large, the upper surface of the pigment ink layer has a concavo-convex shape. In this case, making the upper surface of the pigment ink layer concavo-convex to reduce interference color unevenness of the transparent layer is not required, and the ink application order as described in the first embodiment is kept. On the other hand, in the case where the application amount of the black ink having a small contact angle is large to some extent, the upper surface of the pigment ink layer is a smooth surface. For this reason, in order to reduce the interference color unevenness of the transparent layer, control is performed so as to apply the light cyan ink having a large contact angle in the last half scans, and thereby a shape of the upper surface of the pigment ink layer is made concavo-convex. As described, by optimizing the pigment ink application order, in addition to gloss unevenness, image performance such as interference color unevenness can be improved.

(Image Processing)

Next, a method for generating ejection data in the present embodiment is described with use of FIG. 4B. Unless otherwise described, each step in FIG. 4B is the same as that described with FIG. 4A.

Binary image data for the processing liquid that covers an image printed with the pigment inks is generated not on the basis of the pieces of binary image data for the pigment inks generated in the binarization processing in Step S32. In the present embodiment, an application amount of the processing liquid is set to an approximately 100 duty that enables preferable scratch resistance to be obtained for the image printed with the pigment inks.

In Step S33, on the basis of the pieces of binary image data for the plurality of types of pigment inks, it is determined whether or not application amounts of the inks belonging to the small contact angle group in the predetermined area on the print medium are larger than the predetermined value as compared with application amounts of the inks belonging to the large contact angle group. If the amounts are larger than the predetermined value, in Step S37, the inks belonging to the large contact angle group are set to use an after-mentioned "last half mask pattern". In addition, for the inks belonging to the other contact angle group, that is, for the inks belonging to the small contact angle group, an after-mentioned "normal mask pattern" is used. On the other hand, in Step S33, if the amounts are smaller than the predetermined value, the flow proceeds to Step S36, where for both of the inks belonging to the large contact angle group and the inks belonging to the small contact angle group, the "normal mask pattern" is used.

Specifically, in Step S36, the pieces of binary image data for the plurality of types of pigment inks, and the binary image data for the processing liquid are generated as pieces of ejection data having a format transferable to the print head by the mask pattern processing for distributing the pieces of binary image data to the plurality of scans. At this time, mask patterns used are the "normal mask pattern" and "last half mask pattern" that are set as described above.

(Printing Operation)

Printing operation that performs characteristic control of the present embodiment is described. Note that the "characteristic control" refers to, in the case where an application amount of pigment ink having a small contact angle is larger than the predetermined amount as compared with an application amount of pigment ink having a small contact angle, controlling an application order of the pigment inks so as to apply the ink having a large contact angle in last half scans. In the present embodiment, the multipass printing system that prints an image with the pigment inks for each predetermined area by eight scans in total is also employed. In addition, the processing liquid for covering a surface of a pigment ink image is applied in scans after the image has been printed with the pigment inks. In this embodiment, in order to apply the processing liquid, successive four scans in total were employed. Note that regarding a printing system for the processing liquid, only one scan is also possible, and the number of scans or application method is not limited.

The "normal mask pattern" and "last half mask pattern" used in the present embodiment are the same as those in the first embodiment. That is, the "normal mask pattern" is a mask pattern through which an ink application amount is uniformly distributed to the total eight scans on the 12.5% basis (see FIG. 11). Also, the "last half mask pattern" is a mask pattern through which the inks are not ejected in the first four scans among the total eight scans but ejected to all pixels only in the last half four scans including the last scan (see FIG. 12A). Among the plurality of scans of the print head, a distribution ratio of an ink application amount of each of the first half scans is 0%, and a distribution ratio of an ink application amount of each of the last half scans is 25%. Regarding a specific printing method, the above-described printing method is used, and therefore description is omitted. As described above, in the present embodiment, as in the first embodiment, a relative size relationship in contact angle of pigment ink and an ink application amount are focused on. In the case where an application amount of pigment ink having a relatively small contact angle is larger than the predetermined value as compared with an application amount of pigment ink having a relatively large contact angle, the pigment ink application order is controlled so as to apply the ink having a relatively large contact angle in the last half print scans. Based on this, even in the case of using pigment inks respectively having different contact angles to print an image, a preferable concavo-convex shape can be provided to a surface of the image. Therefore, even if the image is covered by the processing liquid, interference color unevenness is unlikely to occur, and thereby image performance can be improved.

In the present embodiment, in the case where an application amount of pigment ink having a small contact angle is larger than the predetermined value as compared with an application amount of pigment ink having a large contact angle, by applying the ink having a large contact angle in the last half scans, a shape of a surface of an image printed with the pigment inks are controlled to reduce interference color unevenness caused by the processing liquid. In this case, a surface roughness value of a pigment ink layer is large as compared with the non-control case. However, depending on a combination of a plurality of pigment inks and processing liquid, interference color unevenness may be reduced by controlling a surface roughness value of a pigment ink layer to be small. For example, in the case of controlling a surface roughness value of a pigment ink layer to be small to thereby reduce interference color unevenness, if an application amount of pigment ink having a large contact angle is larger than the predetermined value as compared with an application amount of pigment ink having a small contact angle, it is only necessary to apply the pigment ink having a small contact angle in the last half scans. An appropriate surface roughness value of a pigment ink layer depends on pigment inks to be used, print medium, and the like.

Also, in the present embodiment, in addition to the pigment inks to be used to print an image, the processing liquid for improving performance (in the above example, scratch resistance) of the image printed with the pigment inks is separately used. Accordingly, the processing liquid is essentially used separately from the image printing, and therefore preferably in a state close to being clear and colorless. However, the processing liquid may be colored. For example, part or all of pigment inks used for image printing, such as light cyan ink, light magenta ink, and light gray ink, may added with a material for improving a function such as the scratch resistance to thereby make the pigment inks play both roles as image printing and image performance improvement. In this case, additional components for one additional color, such as an ink tank and print head are not required, which can greatly contribute to downsizing and cost reduction. It should be appreciated that among pigment inks used for image printing, part or all of deep color pigment inks may be made to double as the processing liquid in the same manner.

<Other Embodiments>

In the above-described embodiment, the print head is configured such that the ejection ports constituting the nozzles for ejecting the pigment inks and the ejection ports constituting the nozzles for ejecting the processing liquid are mutually displaced in the direction (e.g., sub scanning direction) orthogonal to the main scanning direction (see FIG. 2B). However, a print head configured such that the ejection ports are aligned in the main scanning direction can also be used. Also, the number of nozzles for ejecting the processing liquid may be larger than the nozzles for ejecting any of the pigment inks, and a nozzle array for the former may be longer than a nozzle array for the latter.

Also, the print head may be one that ejects a plurality of types of inks as inks for printing an image, or use a plurality of print heads that eject one type of ink.

Also, the present invention can be widely applied to a variety of inkjet printing devices that perform a plurality of scans of a print head that can eject ink and processing liquid, and thereby print and cover an image with the ink and the processing liquid, respectively, in a predetermined area on a print medium. Accordingly, a configuration of a print head, the number of print heads, and the like are not limited to those in any of the above-described embodiment.

Further, in the above-described embodiment, the pigment inks for improving a function as the scratch resistance and the processing liquid for improving the function as the scratch resistance are exemplified as a specific example. However, pigment inks and processing liquid applicable in the present invention are not limited to such liquids. The pigment inks and processing liquid may be pigment inks and processing liquid that, without limitation to the above function, improve some sort of performance of an image, such as image quality including glossiness, haziness, bronzing characteristic, and the like, and image fastness including water resistance, alkali resistance, weather resistance, and the like. For example, for such inks and processing liquid, in addition to water soluble resin and hydrolysable resin, a material such as silicone oil can be used.

Also, in the above-described embodiment, the pigment inks used to print an image are classified into two groups, i.e., the small contact angle group and the large contact angle group, on the basis of a difference in contact angle; however, the number of classifications is not limited to this. The pigment inks may be classified into many more groups (e.g., three groups, four groups, or the like) according to a degree of a contact angle. Even in this case, by preparing a plurality of predetermined values, a plurality of mask pattern, and the like to control a pigment ink application order in the same manner as that in the above-described embodiment, the effects of the present invention can be obtained.

Further, in the above-described embodiment, the two types of inks, i.e., the black and light cyan inks, are used. In the case of using a plurality of types, i.e., three types of inks, as described, as with an application amount of the black ink among the large contact angle group inks, or an application amount of the light cyan ink among the small contact angle group inks, some ink may be focused on to determine a difference from a predetermined value. Alternatively, on the basis of a sum of application amounts of the large contact angle group inks and a sum of application amounts of the small contact angle group inks, a difference from the predetermined value may be determined.

Still further, in the above-described embodiment, the processing liquid is most effective if the processing liquid is ejected after completion of image printing and present on the uppermost surface of the pigment inks (image). However, part of the processing liquid may be ejected together with the pigment inks in the middle of performing image printing, and present inside a pigment ink layer. As described, in the present invention, the application order of the processing liquid and pigment inks, or a position of the presence of the processing liquid are not limited.

Also, in the above-described embodiment, the pigment inks used to print an image are classified on the basis of a difference in wettability (contact angle) value, and on the basis of whether or not a difference in application amount corresponding to the image is larger than the predetermined value, a method for applying the pigment inks is determined. However, the predetermined value and the method for applying the pigment inks may be determined on the basis of another physical property of the pigment inks, such as a pigment ink-specific glossiness degree based on a composition. Further, the present invention may be configured to change the predetermined value and the application method according to the type of a print medium (the type of an absorbing layer such as a highly absorptive absorbing layer or the type intended purpose such as glossy paper or matte paper). Still further, the present invention may be configured to change the predetermined value and the application method according to the type of a print mode (such as a draft mode or high resolution mode).

Further, the present invention can be applied to all printing devices using a print medium such as paper, fabric, unwoven fabric, or OHP film, and specific applicable devices include office machines such as a printer, copier, and facsimile, mass production machines, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-281935, filed Dec. 17, 2010, which is hereby incorporated by reference herein in its entirety.

What is claimed is:

1. An inkjet printing device comprising:

a print head that ejects a plurality of types of inks including a first ink having a first contact angle to a surface of a predetermined print medium and a second ink having a second contact angle to the surface which is smaller than the first contact angle:

an obtaining unit configured to obtain ejection data representing an application amount of the first ink and the second ink to be ejected to a predetermined area; and an ejection unit configured to, on the basis of the ejection data obtained by the obtaining unit, scan the print head a plurality of times relatively to the predetermined area of a print medium, and to eject the plurality of types of inks from the print head to the predetermined area to print an image, wherein if the ejection data obtained by the obtaining unit represents that the application amount of the first ink is larger than the application amount of the second ink by more than a predetermined value in the plurality of times of scans, the ejection unit ejects the second ink such that an application amount of the second ink to be ejected in last half scans is greater than an application amount of the second ink to be ejected in first half scans, and wherein if the ejection data obtained by the obtaining unit represents that the application amount of the second ink is larger than the application amount of the first ink by more than a predetermined value in the plurality of times of scans, the ejection unit ejects the first ink such that an application amount of the first ink to be ejected in the last half scans is greater than an application amount of the first ink to be ejected in the first half scans.

2. The inkjet printing device according to claim 1, wherein the ejection unit ejects the plurality of types of inks with use of at least two mask patterns for distributing the ejection of the plurality of types of inks to the plurality of times of scans of the print head.

3. The inkjet printing device according to claim 1, wherein the first ink comprises resin having a property of improving performance of an image, and the second ink does not comprise the resin or comprises the resin having an amount smaller than an amount added to the first ink.

4. The inkjet printing device according to claim 1, wherein the performance of an image refers to at least one of characteristics of the image among scratch resistance, weather resistance, water resistance, alkali resistance, glossiness, haziness, and a bronzing characteristic.

5. The inkjet printing device according to claim 1, wherein one of the first and second inks has a property of improving performance of an image that is printed with the plurality of types of inks.

6. The inkjet printing device according to claim 1, wherein if the ejection data obtained by the obtaining unit represents that the application amount of the first ink is larger than the application amount of the second ink by more than a predetermined value in the plurality of times of scans, the ejection unit ejects the second ink such that an application amount of the second ink to be ejected in last half scans is greater than an application amount of the second ink to be ejected in the first half scans, and thereby controls a surface roughness value of the image to be printed with the plurality of types of inks to fall within a predetermined range.

7. The inkjet printing device according to claim 1, wherein if the ejection data obtained by the obtaining unit represents that the application amount of the first ink is larger than the application amount of the second ink by more than a predetermined value in the plurality of times of scans, the ejection unit ejects the second ink such that an application amount of the second ink to be ejected in last half scans is greater than an application amount of the second ink to be ejected in first half scans and the second ink are not to be ejected at least one of the first half scans, and wherein if the ejection data obtained by the obtaining unit represents that the application amount of the second ink is larger than the application amount of the first ink by more than a predetermined value in the plurality of times of scans, the ejection unit ejects the first ink such that an application amount of the first ink to be ejected in last half scans is greater than an application amount of the first ink and the first ink are not to be ejected at least one of the first half scans.

8. The inkjet printing device according to claim 1, wherein the first ink and the second ink include pigment as a color material.

9. An inkjet printing method by an inkjet printing device comprising a print head that ejects a plurality of types of inks including a first ink having a first contact angle to a surface of a predetermined print medium and a second ink having a second contact angle to the surface which is smaller than the first contact angle, the inkjet printing method including:

an obtaining step of obtaining ejection data representing an application amount of the first ink and the second ink to be ejected to a predetermined area;

an ejection step of, on the basis of ejection data obtained by the obtaining step, scanning the print head a plurality of times relatively to a predetermined area of a print medium, and ejecting the plurality of types of inks from the print head to the predetermined area to print an image, wherein if the ejection data represents that the application amount of the first ink is larger than the application amount of the second ink by more than a predetermined value in the plurality of times of scans, the second ink is ejected in the ejection step such that an application amount of the second ink to be ejected in last half scans is greater than an application amount of the second ink to be ejected in first half scans, and wherein if the ejection data represents that the application amount of the second ink is larger than the application amount of the first ink by more than a predetermined value in the plurality of times of scans, the first ink is ejected in the ejection step such that an application amount of the first ink to be ejected in the last half scans is greater than an application amount of the first ink to be ejected in the first half scans.

10. The inkjet printing method according to claim 9, wherein performance of the image refers to at least one of characteristics of the image among scratch resistance, weather resistance, water resistance, alkali resistance, glossiness, haziness, and a bronzing characteristic.

11. An inkjet printing method by an inkjet printing device having a print head provided with: ejection ports that eject a plurality of types of inks including a first ink having a first contact angle to a surface of a predetermined print medium and a second ink having a second contact angle to the surface which is smaller than the first contact angle; and an ejection port that ejects processing liquid having a property of improving performance of an image, the inkjet printing method including:

an obtaining step of obtaining ejection data representing an application amount of the first ink and the second ink to be ejected to a predetermined area;

an ejection step of, on the basis of ejection data obtained by the obtaining step, scanning the print head a plurality of times relatively to a predetermined area of a print medium, ejecting the plurality of types of inks from the print head to the predetermined area to print an image, and the a basis of ejection data that scans the print head to eject the processing liquid from the print head to the predetermined area, and ejecting the processing liquid from the print head onto the image and thereby cover the image with the processing liquid;

wherein if the ejection data obtained by the obtaining unit represents that the application amount of the first ink is larger than the application amount of the second ink by more than a predetermined value in the plurality of times of scans, the ejection unit ejects the second ink such that an application amount of the second ink to be ejected in last half scans is greater than an application amount of the second ink to be ejected in first half scans, and wherein if the ejection data obtained by the obtaining unit represents that the application amount of the second ink is larger than the application amount of the first ink by more than a predetermined value in the plurality of times of scans, the ejection unit ejects the first ink such that an application amount of the first ink to be ejected in the last half scans is greater than an application amount of the first ink to be ejected in the first half scans, and thereby controls a surface roughness value of the image to be printed with the plurality of types of inks to fall within a predetermined range.

* * * * *